US009169047B2

(12) United States Patent
Savenok

(10) Patent No.: US 9,169,047 B2
(45) Date of Patent: Oct. 27, 2015

(54) HOT BEVERAGE CONTAINER LID-INSERT CONSTRUCTIONS

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 0 days.

(21) Appl. No.: 14/547,287

(22) Filed: Nov. 19, 2014

(65) Prior Publication Data

US 2015/0144646 A1 May 28, 2015

Related U.S. Application Data

(60) Provisional application No. 61/908,013, filed on Nov. 22, 2013.

(51) Int. Cl.
*B65D 47/00* (2006.01)
*B65D 1/26* (2006.01)

(52) U.S. Cl.
CPC ..... *B65D 47/00* (2013.01); *B65D 1/265* (2013.01)

(58) Field of Classification Search
CPC ..... A47G 19/2272; A47G 19/2255; A47G 19/2205; B65D 45/22; B65D 45/20; B65D 45/18; B65D 45/16; B65D 47/00; B65D 1/265; B65D 1/26
USPC ..... 220/713, 711, 797, 796, 212, 790, 789, 220/324, 315, 254.1, 256.1; 229/404, 400
See application file for complete search history.

(56) References Cited

U.S. PATENT DOCUMENTS

| | | | | |
|---|---|---|---|---|
| 1,702,606 | A * | 2/1929 | Hulbert | 229/5.7 |
| 2,947,463 | A * | 8/1960 | Conklin | 229/404 |
| 3,083,861 | A * | 4/1963 | Amberg et al. | 220/371 |
| 4,640,435 | A * | 2/1987 | Dutt | 220/790 |
| 5,873,493 | A | 2/1999 | Robinson | |
| 6,176,390 | B1 | 1/2001 | Kemp | |
| 6,488,173 | B2 | 12/2002 | Milan | |
| 7,448,510 | B2 | 11/2008 | Pavlopoulos | |
| 2007/0062943 | A1 | 3/2007 | Bosworth | |
| 2010/0264150 | A1 | 10/2010 | Leon et al. | |
| 2010/0320220 | A1 | 12/2010 | Hussey et al. | |

* cited by examiner

*Primary Examiner* — Robert J Hicks
(74) *Attorney, Agent, or Firm* — Christopher J. Scott

(57) ABSTRACT

A hot beverage lid construction is used in combination with a hot beverage container for enhancing the safety of the outfitted beverage container and for selectively cooling the beverage prior to consumption and preventing spillage. The lid construction includes an inner container wall-engaging, lid-to-wall locking structure. The lid construction is outfitted upon a beverage container such that the inner container wall-engaging, lid-to-wall locking structure engages and effectively locks the lid construction to inner container wall surfacing of the beverage container. The lid construction, being outfitted upon the beverage container, defines a lower beverage-receiving compartment and at least one upper beverage flow channel. Each beverage flow channel effectively functions to receive heat from channel-received beverage before the channel-received beverage exits the primary beverage outlet. A bypass element is selectively removable from a lower-inner material layer of the lid construction so as to enable the user to bypass flow channel functionality.

23 Claims, 44 Drawing Sheets

11A 52
60
30
40
51
30
51
60
50
112A 112A
12
18E 50
30
60
52
40
30
60
112A
32

60
30
40
52
50
51
30
60
32

112A
12
52
50
18B
30

12
18A

HOT BEVERAGE CONTAINER LID-INSERT CONSTRUCTIONS

PRIOR HISTORY

This patent application claims the benefit of or priority to U.S. Provisional Patent Application No. 61/908,013 filed in the United States Patent and Trademark Office on 22 Nov. 2013.

BACKGROUND OF THE INVENTION

1. Field of the Invention

The present invention relates generally to a lid construction or assembly for outfitting a hot beverage container. More particularly, the present invention relates to a combination lid-insert construction or assembly for outfitting a hot beverage container for enabling the drinker to selectively transfer heat from a hot beverage prior to consumption, preventing inadvertent removal of the lid-insert construction from the outfitted hot beverage container, and preventing spillage of beverage from a beverage container.

2. Brief Description of the Prior Art

The broad field of lids for hot beverage containers and hot beverage container assemblies inclusive of lids is exceedingly well-developed. The art relating to means for cooling hot beverages prior to consumption by way of a lid construction or assembly is a bit more limited. In any case, it is most difficult to pinpoint with precision the most pertinent art relevant to the present invention given the wide swath of art swept by beverage container constructions and developments in the field of art generally. Nevertheless, some of the more pertinent prior is believed to be briefly described hereinafter.

U.S. Pat. No. 5,873,493 ('493 Patent), which issued to Robinson, for example, discloses an Integrally Molded Measurer Dispenser. The '493 Patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 Patent), which issued to Kemp, discloses a Container Lid with Cooling Reservoir. The '390 Patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 6,488,173 ('173 Patent), issued to Milan, discloses a Beverage container lid having baffle arrangement for liquid cooling. The '173 Patent describes a removable beverage container lid wherein the lid has a substantially enclosed space defined between an exterior cover and an interior cover. At least one inlet opening is formed in the interior cover directing a hot beverage to flow into the substantially enclosed space. Attached to the interior cover at the forward edge of the inlet opening is a partition or wall assembly having a height extending to be located substantially against the exterior cover and a length at least equal to the length of the inlet opening. Between the partition or wall assembly and the peripheral edge of the exterior cover is located a gap area. Connected with the gap area is a dispensing opening formed in the exterior cover. Hot beverage is required to flow around the partition or wall assembly and into the gap area prior to flowing through the dispensing opening exteriorly of a beverage container.

U.S. Pat. No. 7,448,510 ('510 Patent), which issued to Pavlopoulos, discloses a Cup Assembly having a Cooling Compartment. The '510 Patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

United States Patent Application No. 2007/0062943, which was authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

United States Patent Application No. 2010/0264150, which was authored by Leon et al., describes a disposable beverage cup a disposable beverage cup that comprises a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

United States Patent Application No. 2010/0320220, which was authored by Hussey et al., describes a plastic lid for a drinks container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover.

The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure.

From a consideration of the foregoing, it will be noted that the prior art perceives a need for a low cost lid and/or lid-insert construction or assembly usable in combination with a disposable hot beverage container assembly so as to enable the user to selectively transfer heat from the hot beverage via the lid elements outfitted upon the container so as to avoid scalding prior to beverage consumption, prevent spillage of (hot) beverage from the container, and preventing inadvertent removal of the lid elements as exemplified by the lid-insert construction from the outfitted hot beverage container. More particularly, the prior art further perceives a need for a lid-insert combination that becomes difficult to remove or effectively non-removable from an outfitted hot beverage container once outfitted thereupon so as to prevent scalding or spillage of hot beverage via inadvertent lid assembly removal. In this last regard, the prior art perceives a need for such a combination hot beverage container lid-insert assembly or combination and/or lid methodology supported thereby as summarized in more detail hereinafter.

SUMMARY OF THE INVENTION

To achieve the aforementioned and other readily apparent objectives, the present invention essentially discloses a hot beverage container lid-insert assembly for enabling a user/drinker to selectively transfer heat from a relatively hot assembly-contained beverage so as to cool the beverage before it enters the user's/drinker's mouth. The present invention is thus contemplated to provide certain low-cost, disposable means for transferring thermal energy from a relatively hot liquid beverage to relatively cool surroundings so as to prevent scalding before consumption thereof.

Further, the present disclosure attempts to teach certain means for preventing the lid-insert construction from inadvertent removal from a hot beverage container assembly once outfitted thereupon. Still further, the present disclosure attempts to teach a beverage delivery capsule and method of preventing spillage of beverage in food and/or beverage delivery mechanisms. It is specifically designed for on the go (or to go) drive-thru vacuum or mechanical food or beverage delivery systems.

In this regard, the present invention provides a beverage container assembly having a locked and selectively sealed lid-insert construction that functions to prevent spillage, including spillage in automated food and/or beverage delivery processes. When viewed in combination with a hot beverage container assembly, the present invention is believed to comprise a container structure, a lid structure, and an insert construction that is preferably outfitted to the lid construction such that once outfitted, the removal of the lid-insert construction or combination from the container structure becomes difficult.

In this last regard, the lid-insert construction according to the present invention preferably comprises an outwardly extended container-engaging or piercing structure that extends radially outward from an inner portion of the insert periphery such that the container-engaging or piercing structure engages or pierces the inside surfacing of a hot beverage container. Once outfitted upon the hot beverage container by downwardly directed force, the lid-insert construction may optionally become obliquely and upwardly extended and thereby engages or pierces the inside surfacing of the container to provide stop structure for preventing upwardly directed motion of the lid-insert construction relative the hot beverage container.

The essential container structure is believed to preferably comprise a container bottom, a pierceable or engageable inner container wall, and an upper container rim. The upper container rim has a rim perimeter, which rim perimeter preferably extends in a rim plane. The lid-insert construction according to the present invention is believed to preferably comprise a lip top, a lid wall, a lower lid rim having a container rim-receiving groove, and a container-engaging or piercing structure that is preferably obliquely and upwardly extended relative to the container and lid rim planes. The lower lid rim receives or is otherwise attachably cooperable with the upper container rim and the container-engaging or piercing structure engages or pierces the inner container wall for securing the lid elements to the container.

Central to the practice of the present disclosure is the container-engaging or piercing structure of the lid-insert combination, which container-engaging or piercing structure is preferably obliquely angled relative to the lid rim plane and upwardly extended toward the lid top. The obliquely and upwardly extended container-engaging or piercing structure or construction preferably comprises an outer wall-engaging structure as variously exemplified in the drawings accompanying this disclosure. The obliquely and upwardly extended container-engaging or piercing structure is contemplated to be preferably formed from an elastic or resilient, thermally-insulative, food-grade, and heat-resistant material. It is contemplated that the material should undergo minimal or minimized structural/dimensional changes when heat is transferred into the material. The obliquely and upwardly extended container-engaging or piercing structure is preferably sized and shaped for engagement with the inner wall or surfacing of the hot beverage container.

BRIEF DESCRIPTION OF DRAWINGS

Other features of the present invention will become more evident from a consideration of the following brief descriptions of patent drawings.

Figure 12B:
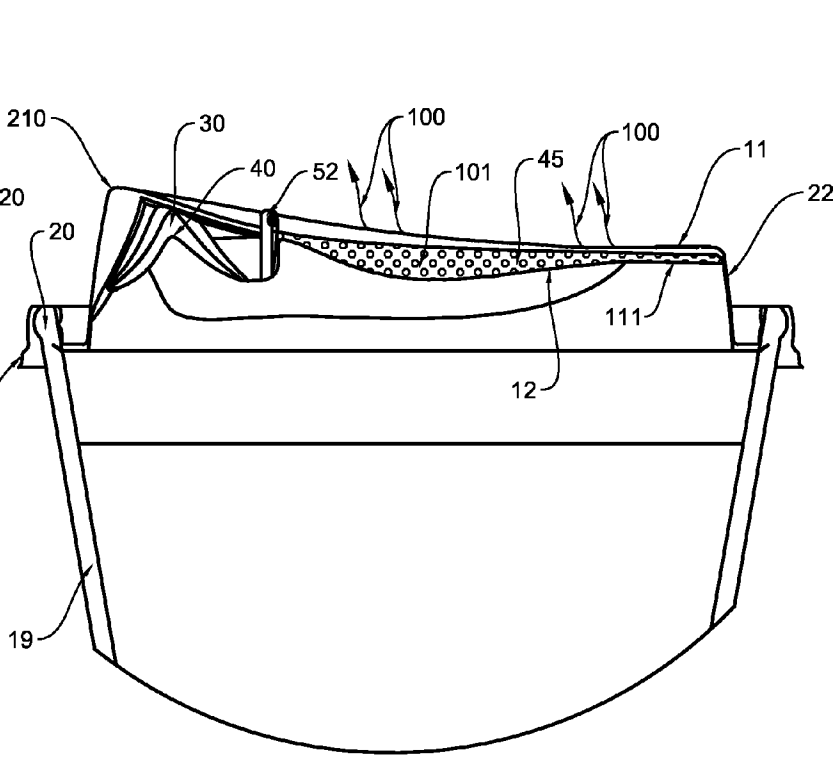
FIG. 12B is an enlarged, fragmentary sectional depiction of the upper portions of the beverage container as outfitted with a generic lid-insert construction according to the present invention showing beverage received in a beverage-receiving flow channel.
Figure 12A:
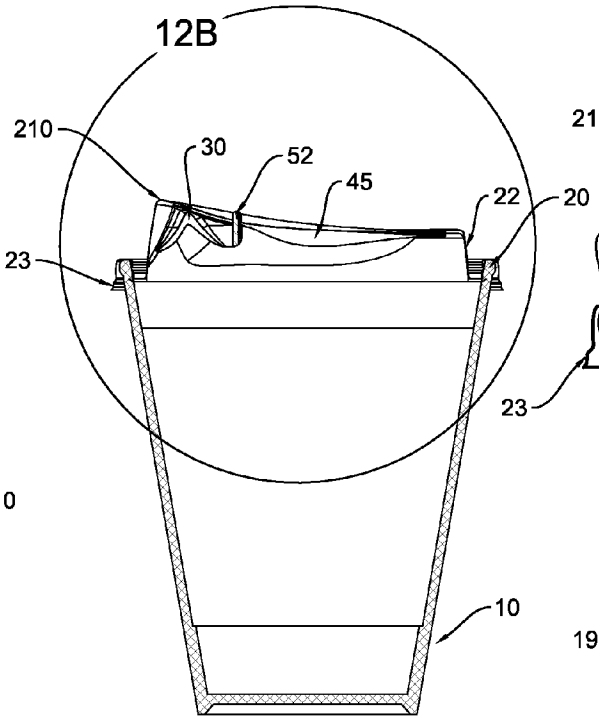
FIG. 12A is an enlarged, longitudinal cross-sectional depiction of a generic lid-insert construction outfitted upon or attached to the beverage container as sectioned from FIG. 12.
Figure 12:
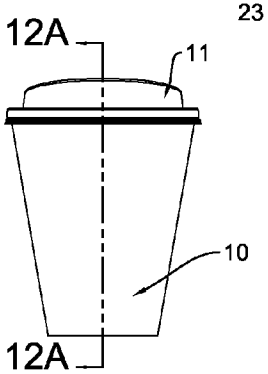
FIG. 12 is a reduced side elevational view of a generic lid-insert construction according to the present invention as outfitted upon or attached to a beverage container.
Figure 12C:
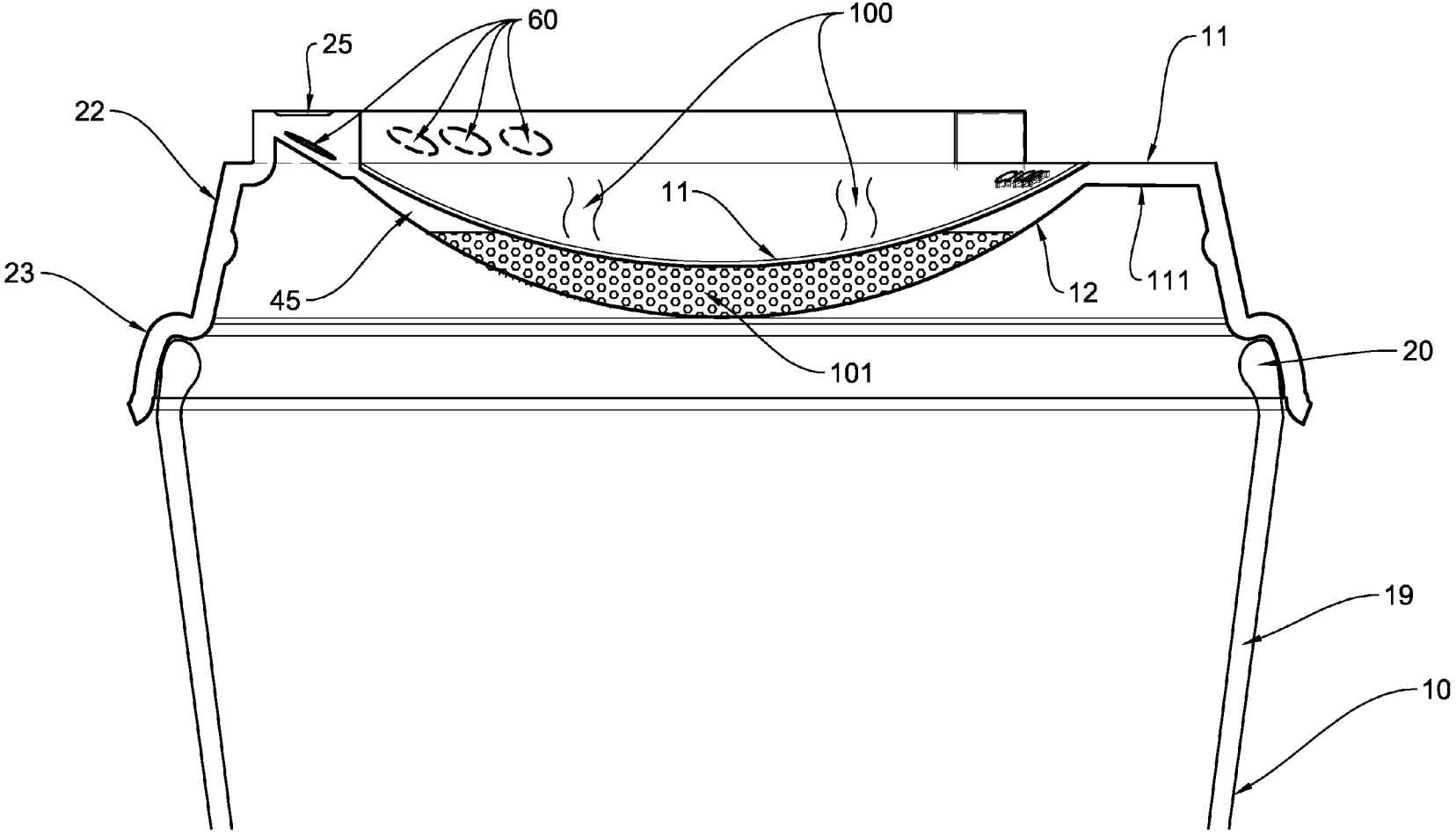
FIG. 12C is an enlarged, fragmentary sectional depiction of the upper portions of the beverage container as outfitted with an alternative lid-insert construction according to the present invention showing beverage received in a beverage-receiving flow channel and showing damming insert apertures formed in an inner material layer.
Figure 13A:
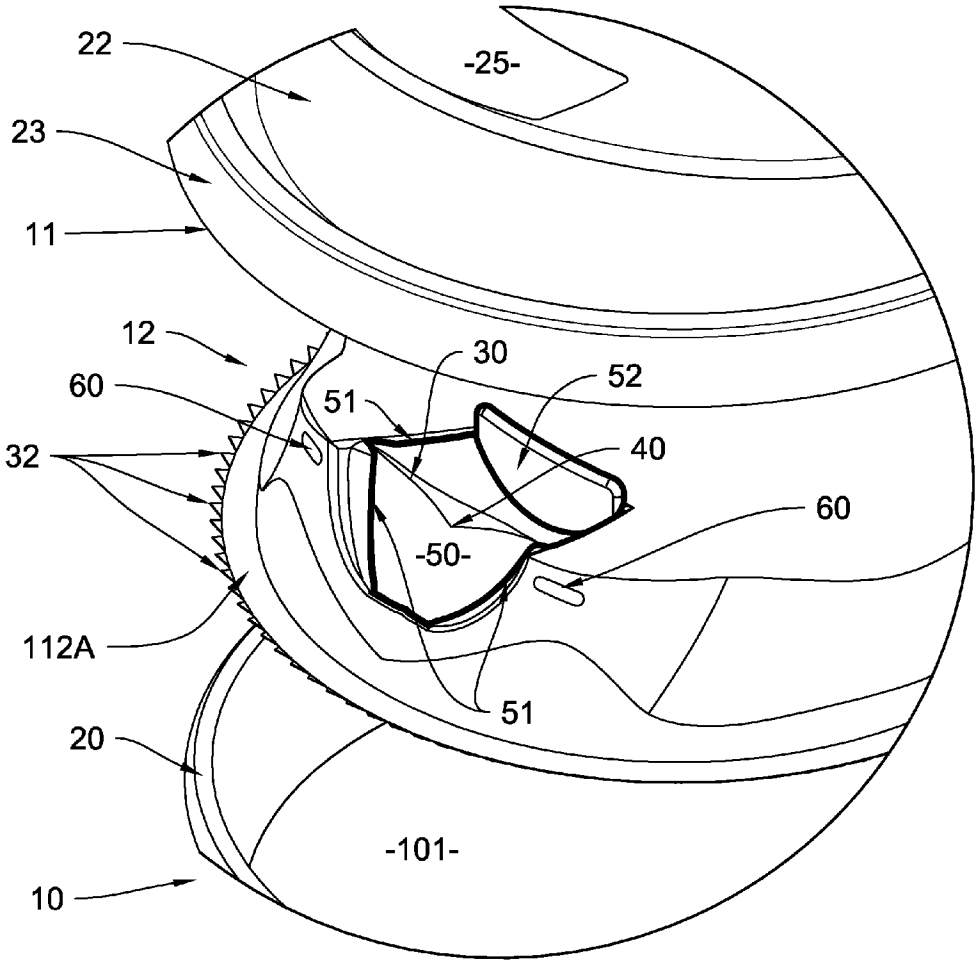
FIG. 13A is an enlarged, fragmentary sectional view of the junction site sectioned from FIG. 13, the view being enlarged to show in greater clarity certain components as otherwise shown and sectioned from FIG. 13 so as to show the first alternative insert construction being outfitted with laterally opposed singular damming insert apertures.
Figure 13:
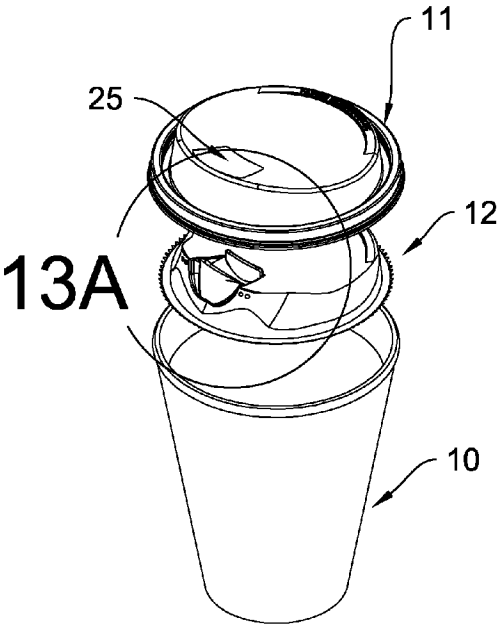
FIG. 13 is a reduced top perspective exploded view of a lid construction, a first alternative insert construction and a beverage container according to the present invention axially aligned relative to one another, the first alternative insert construction being outfitted with laterally opposed singular damming insert apertures.
Figure 14:
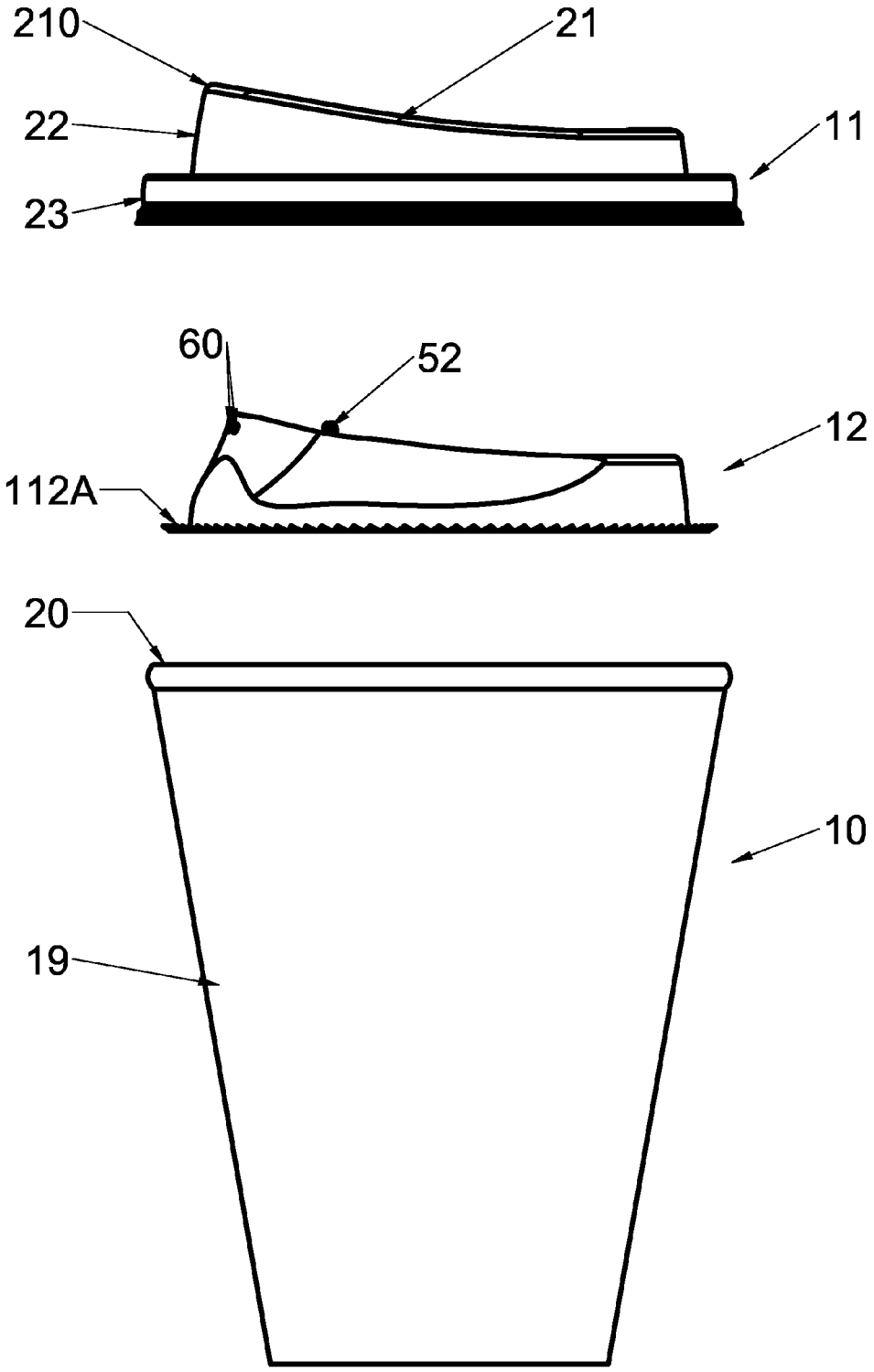
FIG. 14 is a first side exploded view of first alternative lid-insert combination according to the present invention juxtaposed in superior adjacency to a generic beverage container, the elements being depicted in vertical alignment with one another.
Figure 15:
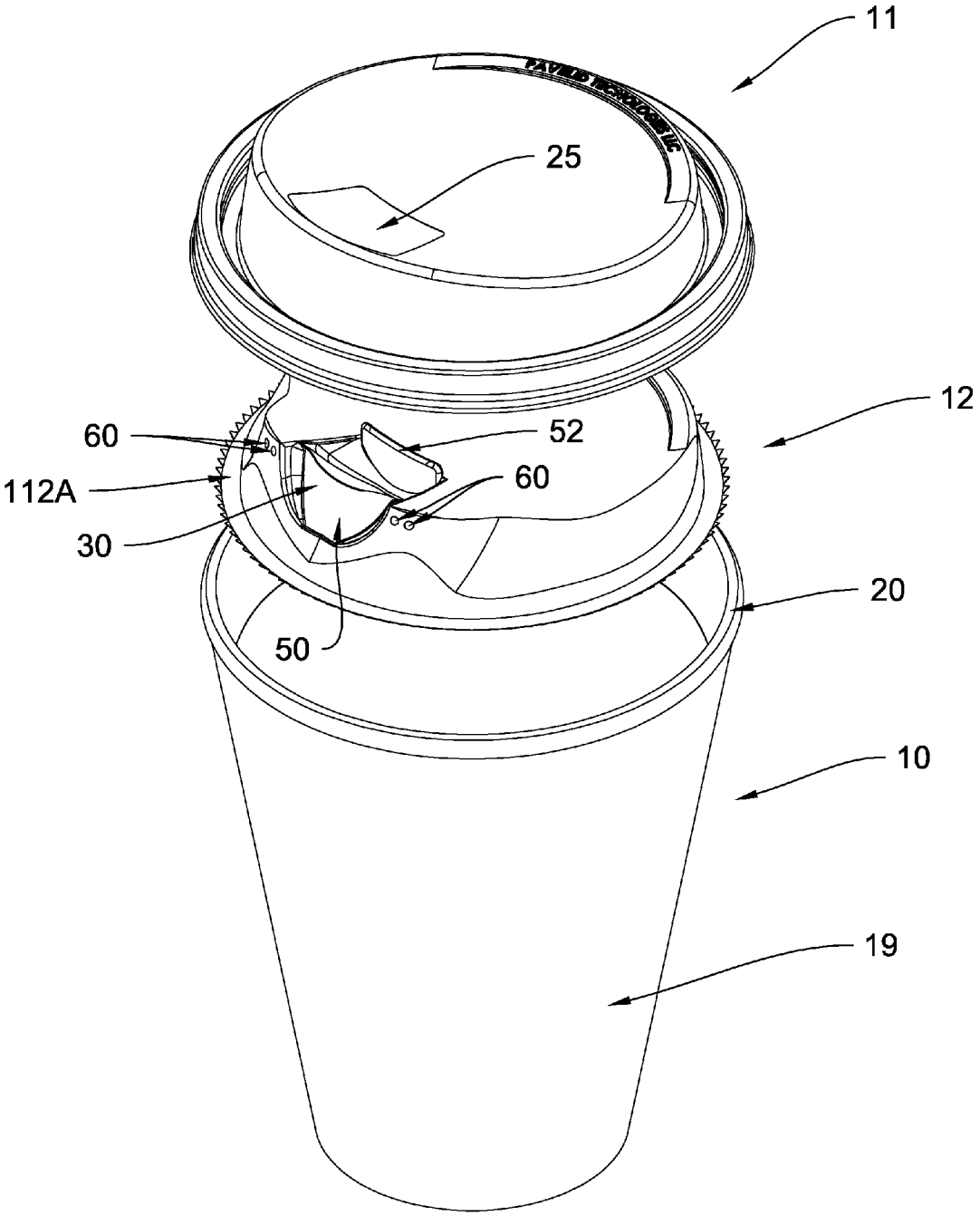
FIG. 15 is a top perspective exploded view of the first alternative lid-insert combination according to the present invention juxtaposed in superior adjacency to a generic beverage container, the elements being depicted in axial alignment with one another.
Figure 16:
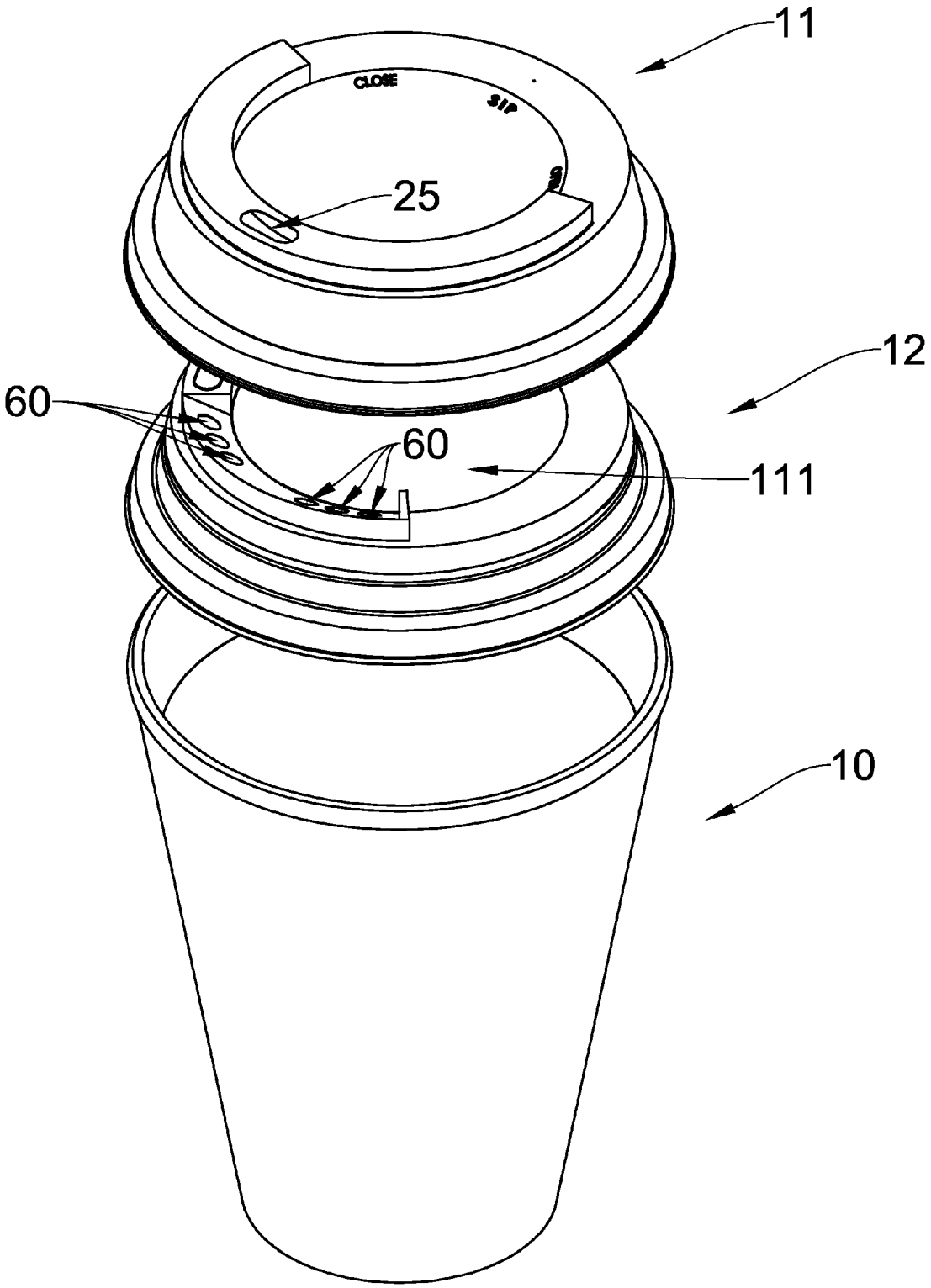
FIG. 16 is an enlarged exploded top perspective view of from top to bottom, an lid construction (also shown in FIGS.

10A and 12C), an insert construction (also shown in FIGS. 10A and 12C), and a beverage container according to the present invention.

Figure 17:
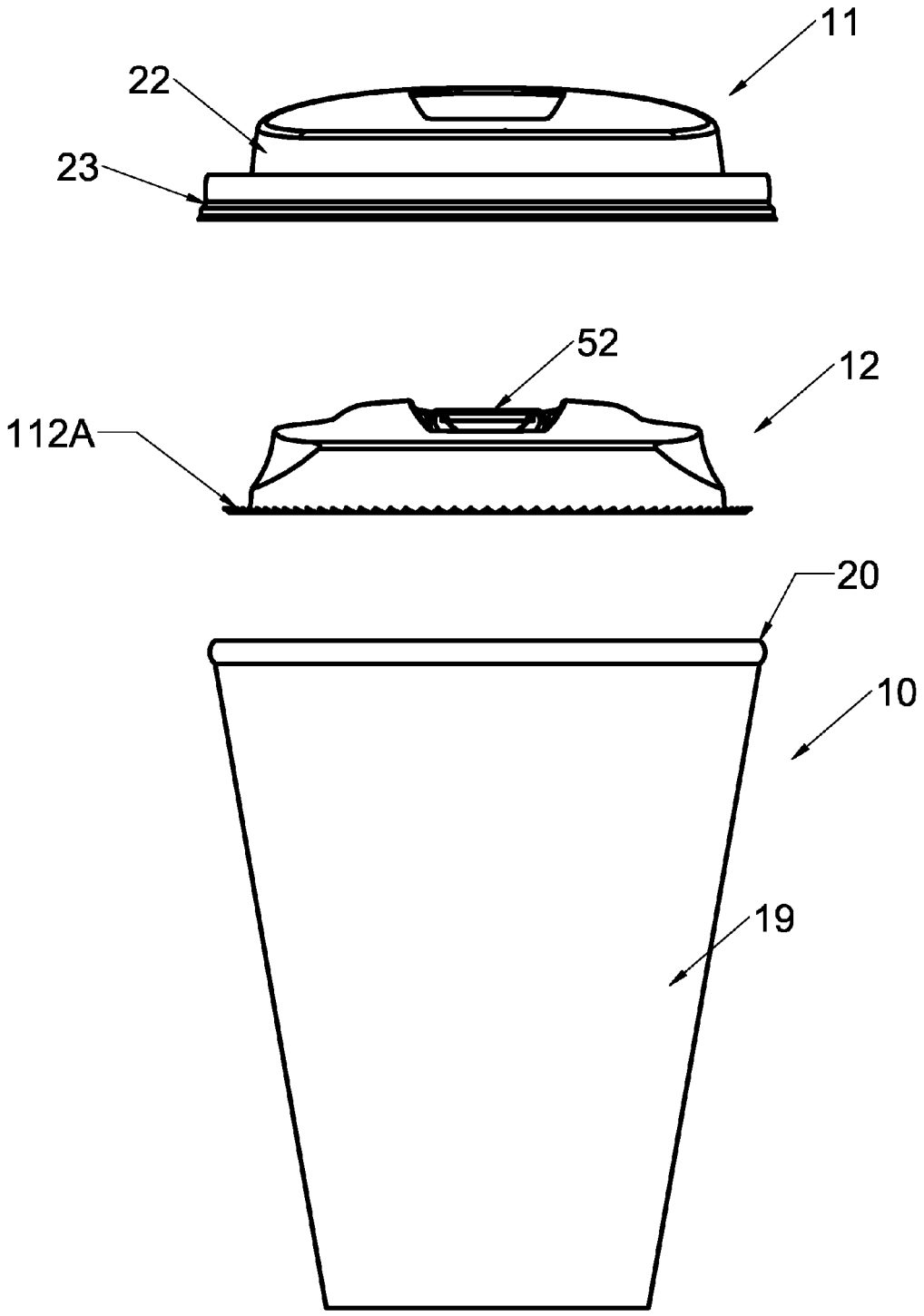

FIG. 17 is a second side exploded view of the first alternative lid-insert combination according to the present invention juxtaposed in superior adjacency to a generic beverage container, the elements being depicted in vertical alignment with one another.

Figures 18A, 18B, 18C, 18D, 18E, 18F:
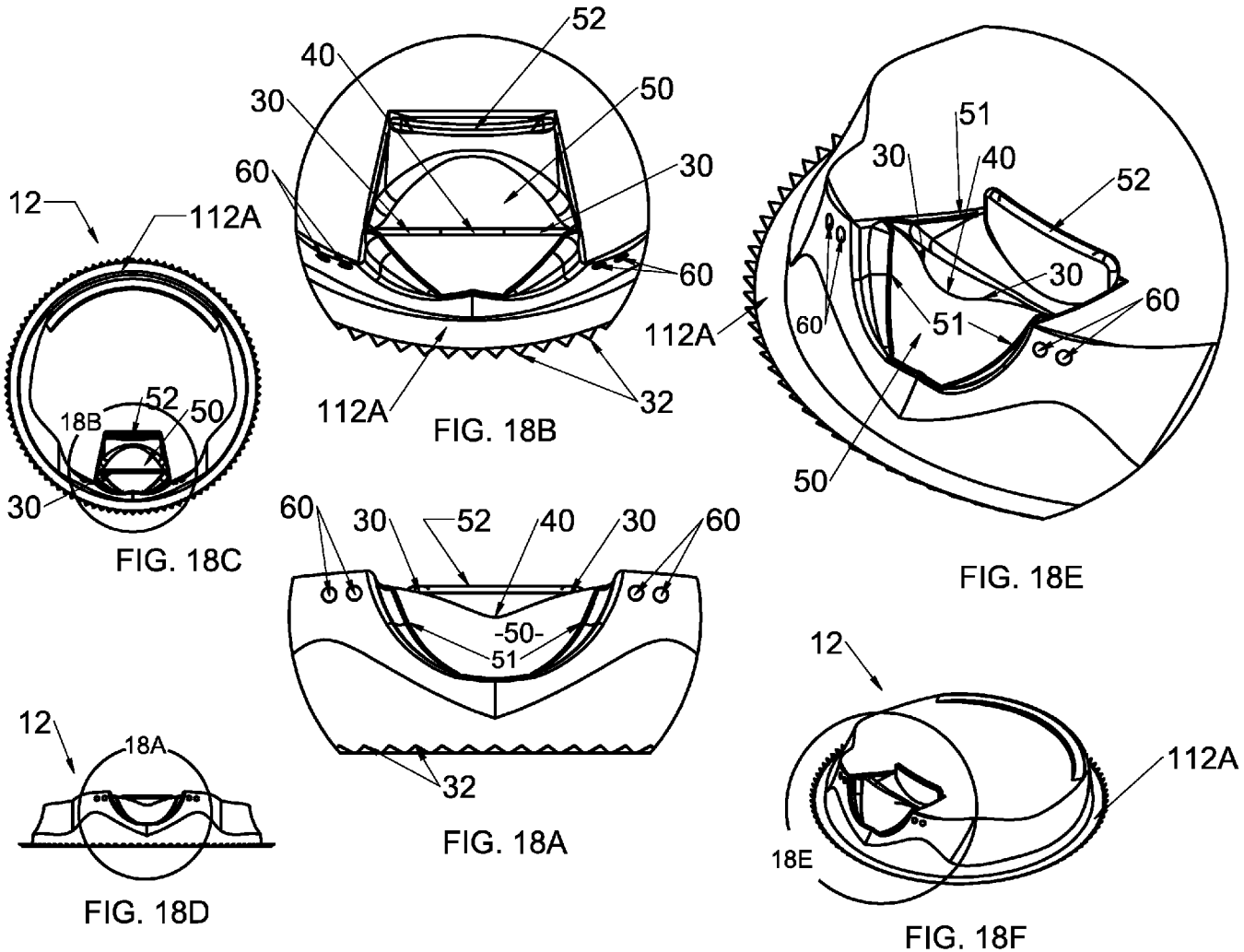

FIG. 18A is an enlarged fragmentary frontal elevational type depiction of a portion of the first alternative lid insert construction according to the present invention highlighting the beverage-damming ridge and removable bypass element, the view being enlarged and sectioned from the depiction otherwise appearing in FIG. 18D.

FIG. 18B is an enlarged fragmentary top view depiction of a portion of the first alternative lid insert construction according to the present invention highlighting the beverage-damming ridge and removable bypass element, the view being enlarged and sectioned from the depiction otherwise appearing in FIG. 18C.

FIG. 18C is a top view depiction of the first alternative lid insert construction according to the present invention highlighting the beverage-damming ridge and removable bypass element.

FIG. 18D is a frontal elevational type depiction of the first alternative lid insert construction according to the present invention highlighting the beverage-damming ridge and removable bypass element.

FIG. 18E is an enlarged fragmentary top perspective type depiction of a portion of the first alternative lid insert construction according to the present invention highlighting the beverage-damming ridge and removable bypass element, the view being enlarged and sectioned from the depiction otherwise appearing in FIG. 18F.

FIG. 18F is a first top perspective type depiction of the first alternative lid insert construction according to the present invention highlighting the beverage-damming ridge and removable bypass element.

Figure 19A:
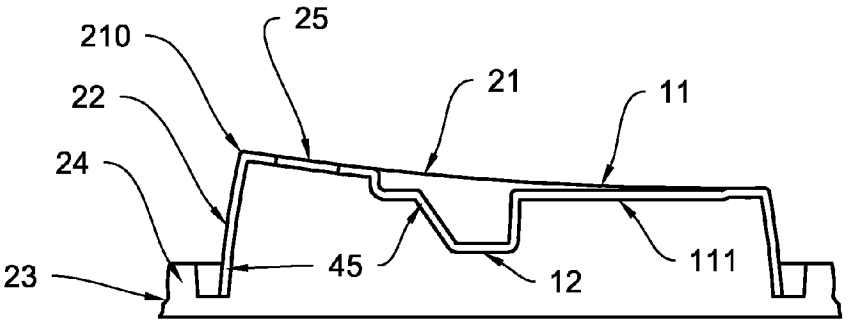
FIG. 19A PRIOR ART
Figure 19:
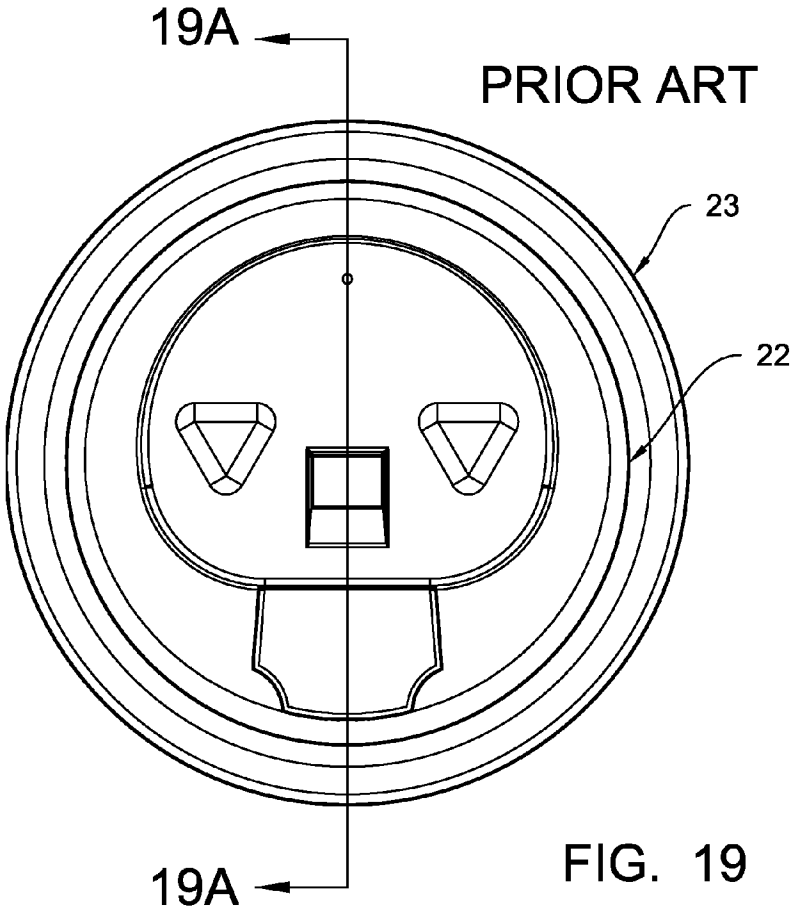

FIG. 19 is a top plan type depiction of a prior art first type of lid construction usable in combination with an insert construction according to the present invention.

FIG. 19A is a longitudinal cross-sectional type depiction of the prior art lid construction otherwise depicted in FIG. 19, the longitudinal cross-sectional type depiction being presented to show the prior art lid construction in an upper position and an insert construction according to the present invention in a lower position, the lower insert construction mimicking the contour of portions of the upper lid construction to provide a beverage-receiving flow channel in the space between the upper lid and lower insert constructions.

Figure 20A:
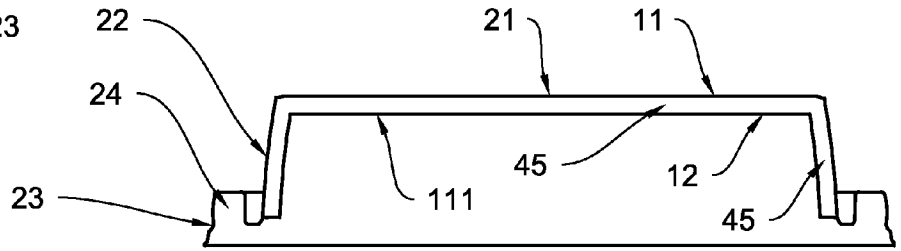
Figure 20:
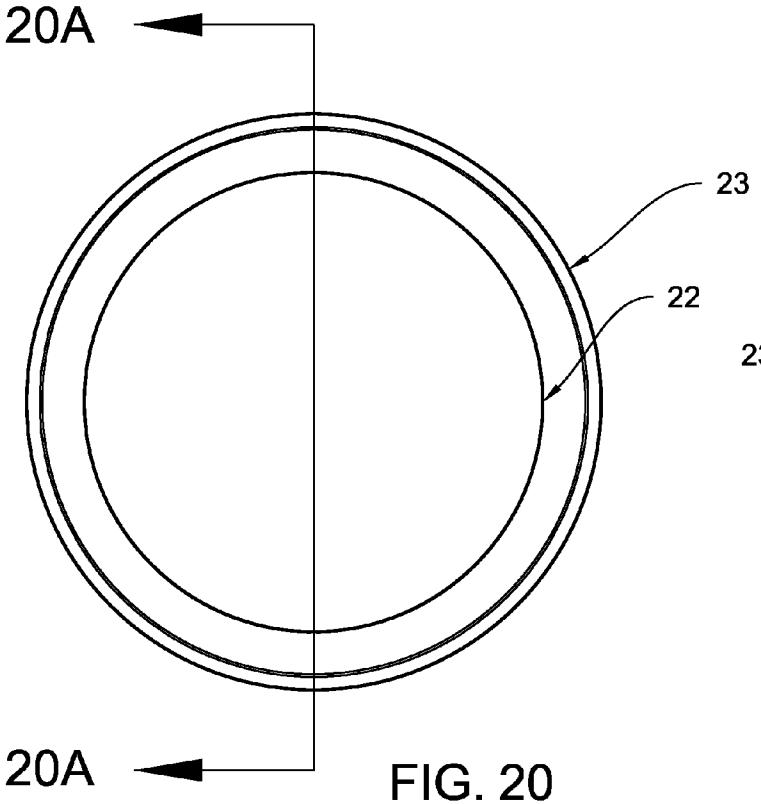

FIG. 20 is a top plan type depiction of a generic second type of lid construction usable in combination with an insert construction according to the present invention.

FIG. 20A is a longitudinal cross-sectional type depiction of the generic lid construction otherwise depicted in FIG. 20, the longitudinal cross-sectional type depiction being presented to show the prior art lid construction in an upper position and an insert construction according to the present invention being shown in a lower position, the lower insert construction mimicking the contour of portions of the upper lid construction to provide a beverage-receiving flow channel in the space between the upper lid and lower insert constructions.

Figure 20C:
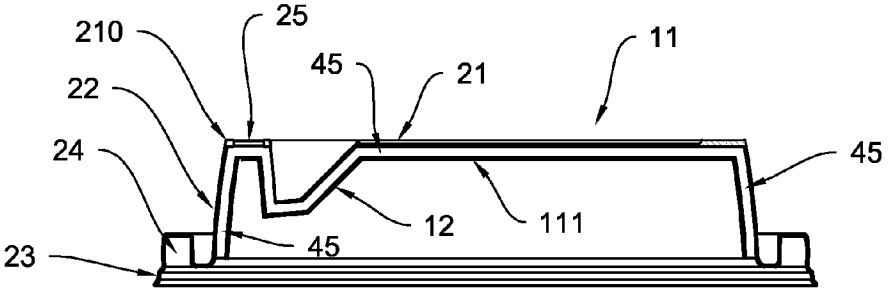
Figure 20B:
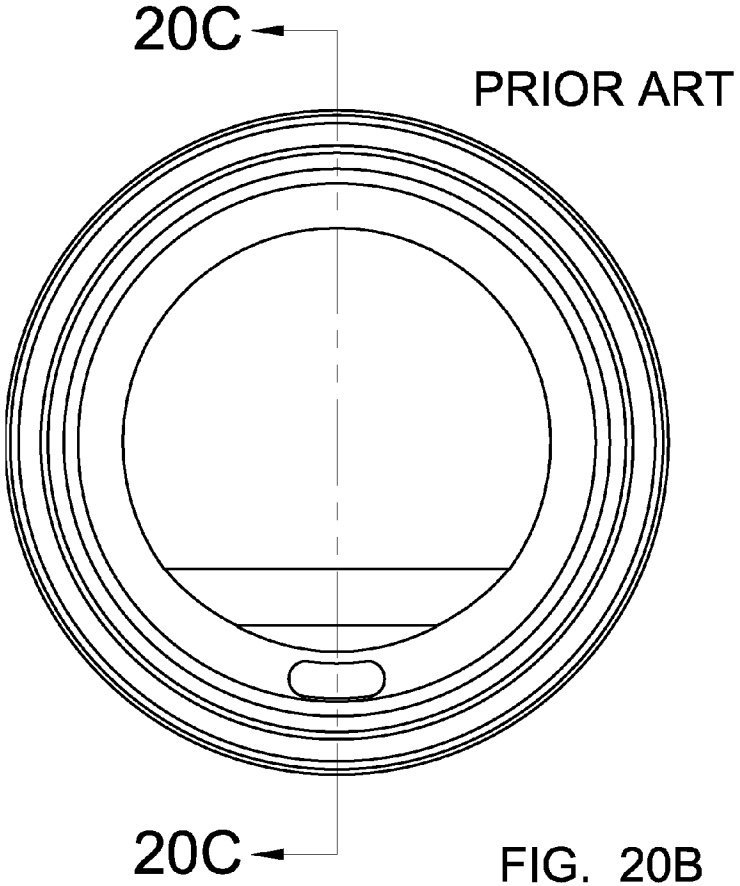

FIG. 20B is a top plan type depiction of a prior art third type of lid construction usable in combination with an insert construction according to the present invention.

FIG. 20C is a longitudinal cross-sectional type depiction of the prior art lid construction otherwise depicted in FIG. 20B, the longitudinal cross-sectional type depiction being presented to show the prior art lid construction in an upper position and an insert construction according to the present invention being shown in a lower position, the lower insert construction mimicking the contour of portions of the upper lid construction to provide a beverage-receiving flow channel in the space between the upper lid and lower insert constructions.

Figure 21A:
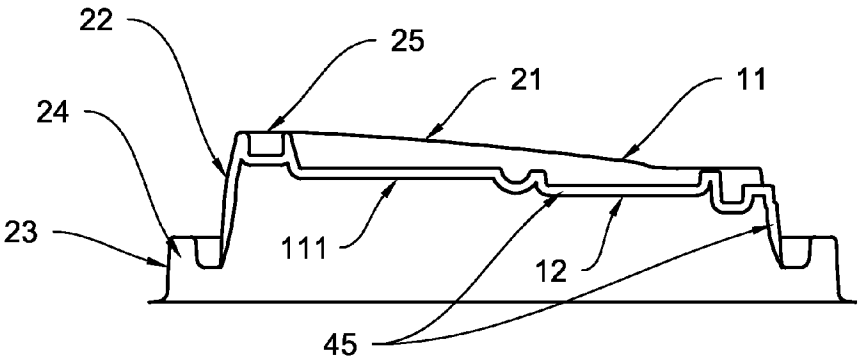
FIG. 21A PRIOR ART
Figure 21:
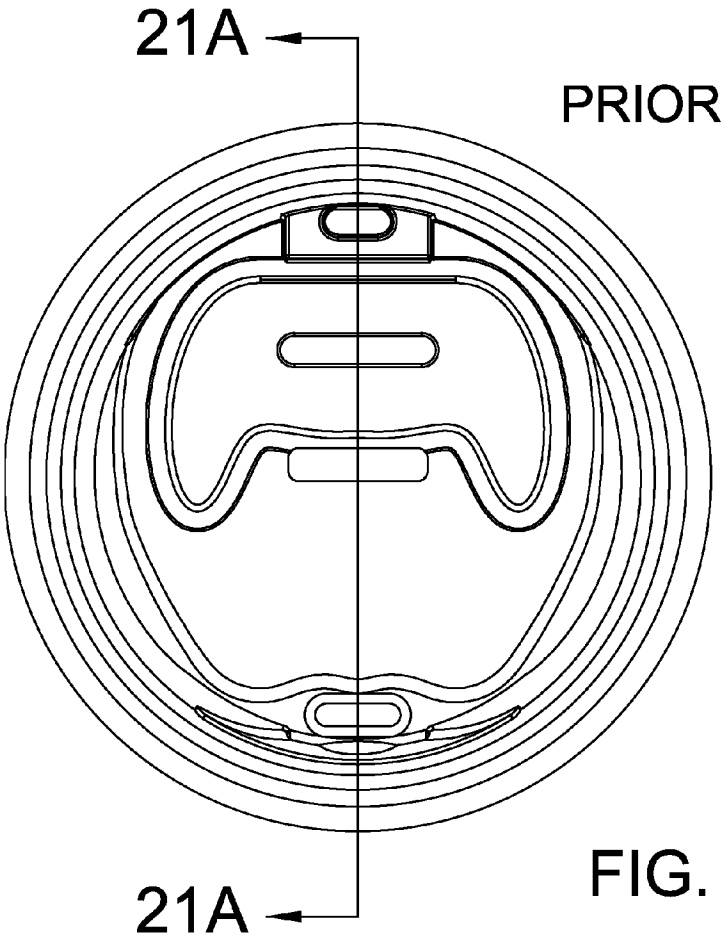

FIG. 21 is a top plan type depiction of a prior art fourth type of lid construction usable in combination with an insert construction according to the present invention.

FIG. 21A is a longitudinal cross-sectional type depiction of the prior art lid construction otherwise depicted in FIG. 21, the longitudinal cross-sectional type depiction being presented to show the prior art lid construction in an upper position and an insert construction according to the present invention being shown in a lower position, the lower insert construction mimicking the contour of portions of the upper lid construction to provide a beverage-receiving flow channel in the space between the upper lid and lower insert constructions.

Figure 22A:
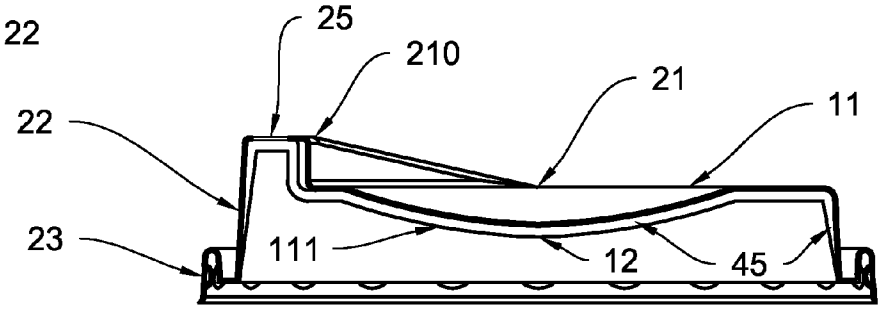
FIG. 22A PRIOR ART
Figure 22:
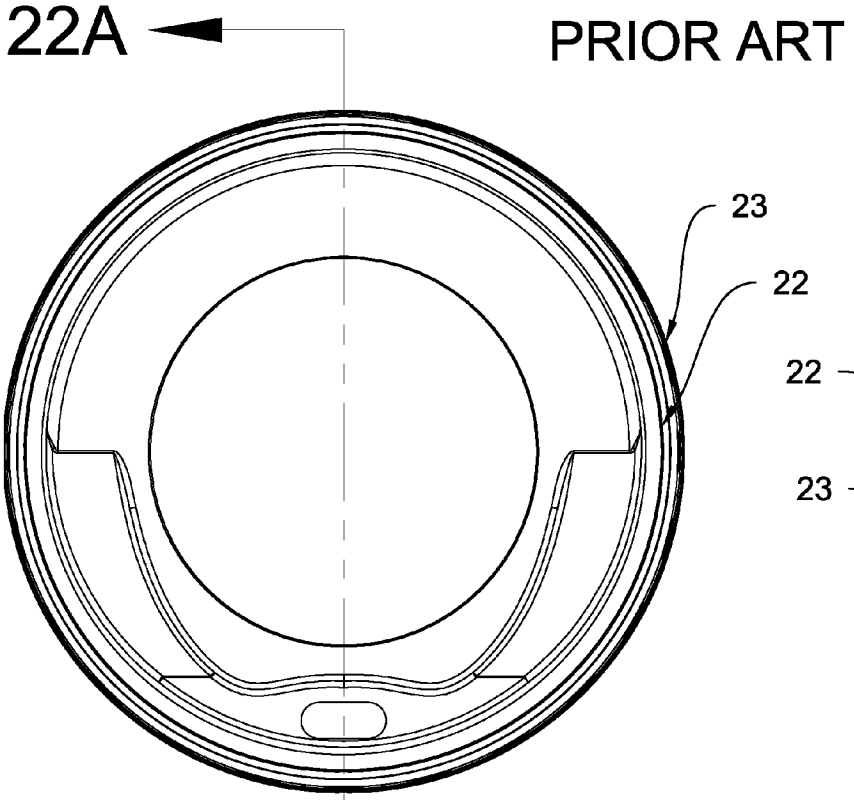

FIG. 22 is a top plan type depiction of a prior art fifth type of lid construction usable in combination with an insert construction according to the present invention.

FIG. 22A is a longitudinal cross-sectional type depiction of the prior art lid construction otherwise depicted in FIG. 22, the longitudinal cross-sectional type depiction being presented to show the lid construction in an upper position and an insert construction according to the present invention being shown in a lower position, the lower insert construction mimicking the contour of portions of the upper lid construction to provide a beverage-receiving flow channel in the space between the upper lid and lower insert constructions.

Figure 23A:
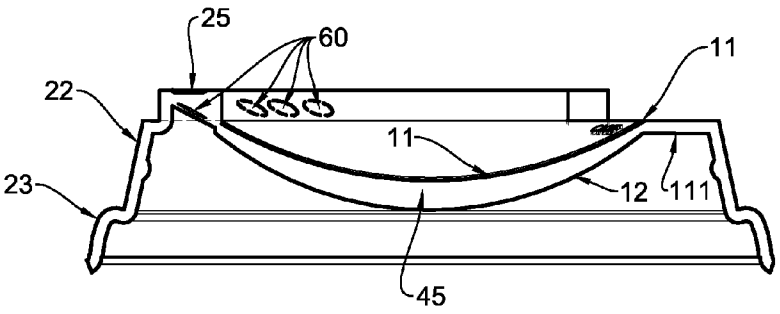
Figure 23:
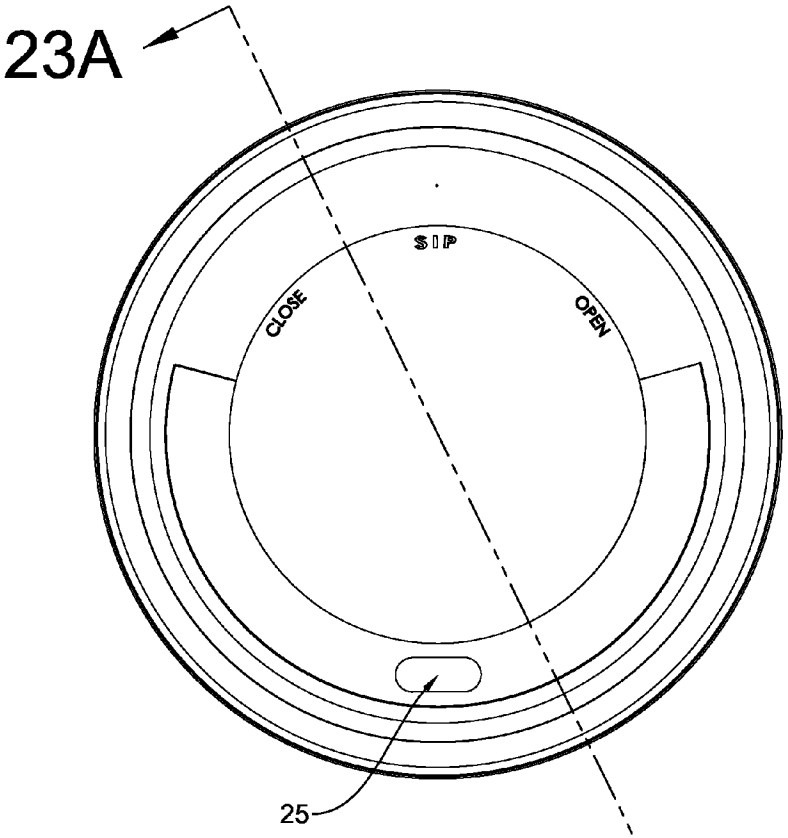

FIG. 23 is a top plan type depiction of a generic sixth type of lid construction usable in combination with an insert construction according to the present invention.

FIG. 23A is a longitudinal cross-sectional type depiction of the generic lid construction otherwise depicted in FIG. 23, the longitudinal cross-sectional type depiction being presented to show the lid construction in an upper position and an insert construction according to the present invention being shown in a lower position, the lower insert construction mimicking the contour of portions of the upper lid construction to provide a beverage-receiving flow channel in the space between the upper lid and lower insert constructions.

Figure 24A:
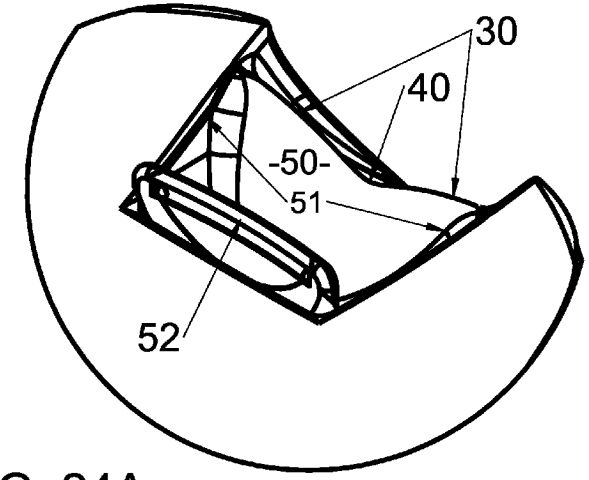
Figure 24C:
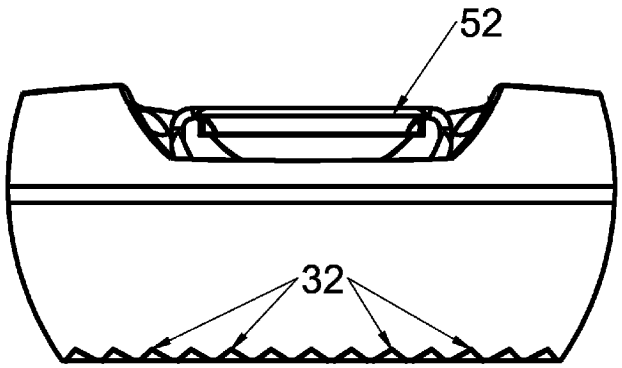
Figure 24:
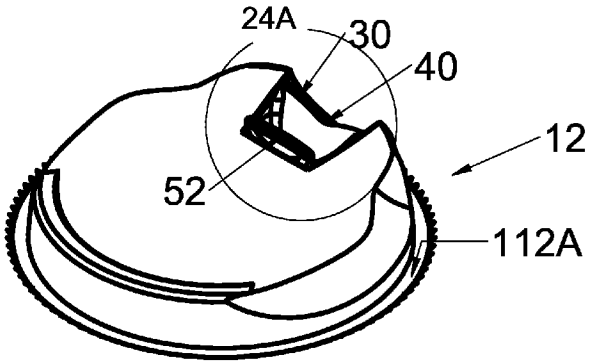

FIG. 24 is a third top perspective type depiction of the first alternative lid insert construction according to the present invention highlighting the beverage-damming ridge and removable bypass element.

FIG. 24A is an enlarged, fragmentary top perspective type depiction of a portion of the first alternative lid insert construction according to the present invention highlighting the beverage-damming ridge and removable bypass element, the view being enlarged and sectioned from the depiction otherwise appearing in FIG. 24.

Figure 24B:
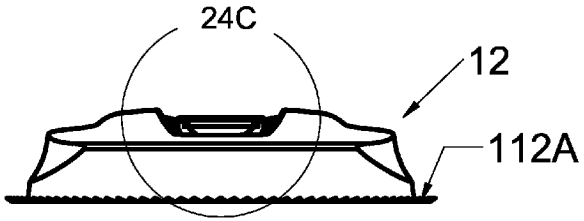

FIG. 24B is a rearward, elevational type depiction of a preferred lid insert construction according to the present invention highlighting the beverage-damming ridge and removable bypass element.

FIG. 24C is an enlarged fragmentary rearward depiction of a portion of the first alternative lid insert construction according to the present invention highlighting a pull tab, the view being enlarged and sectioned from the depiction otherwise appearing in FIG. 24B.

Figure 25:
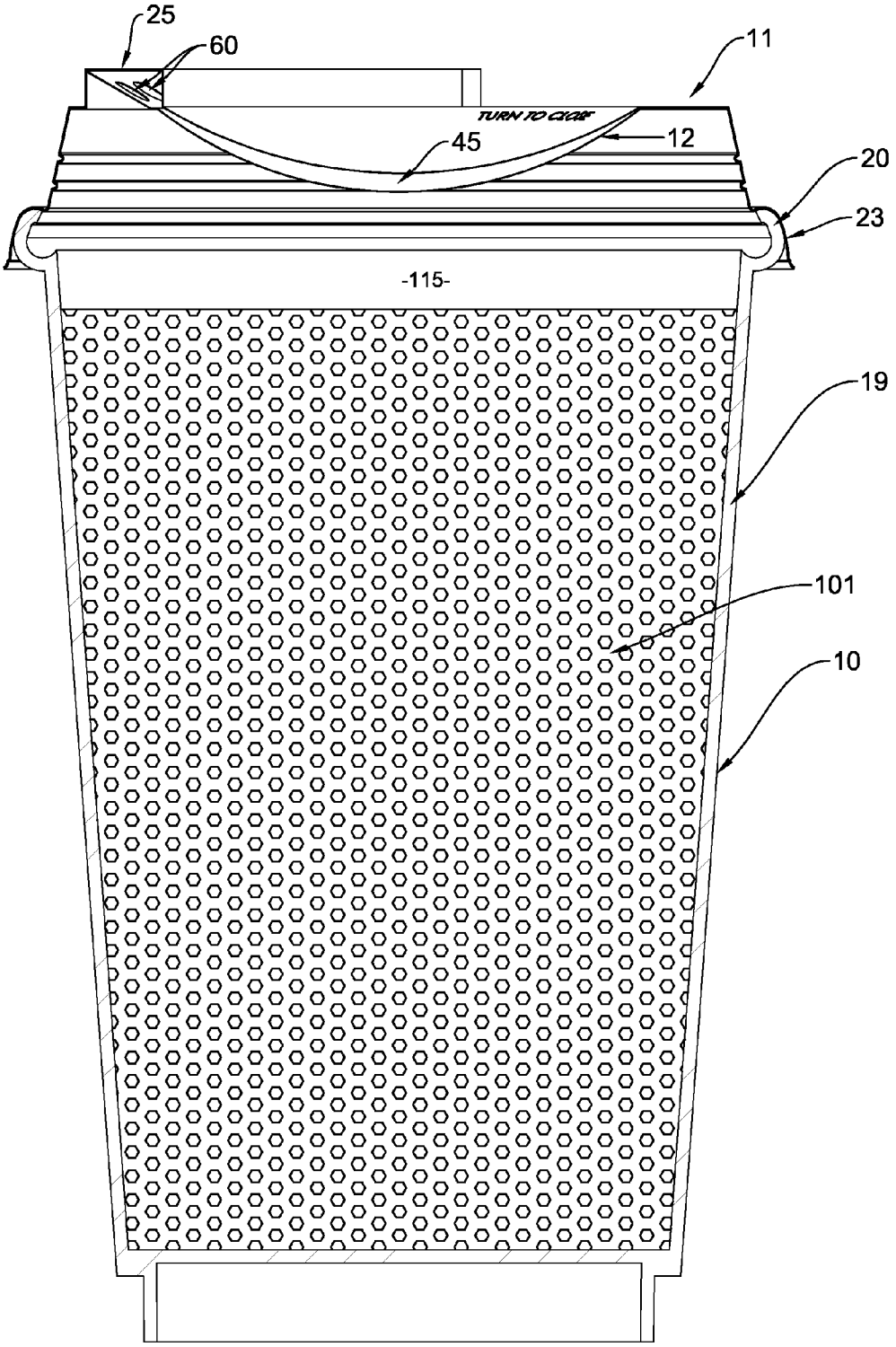

FIG. 25 is a first sequential diagrammatic longitudinal cross-sectional type depiction of a beverage container outfitted with an alternative lid-insert construction according to the present invention shown in a vertical orientation before beverage is redirected toward the primary beverage outlet.

Figure 25A:
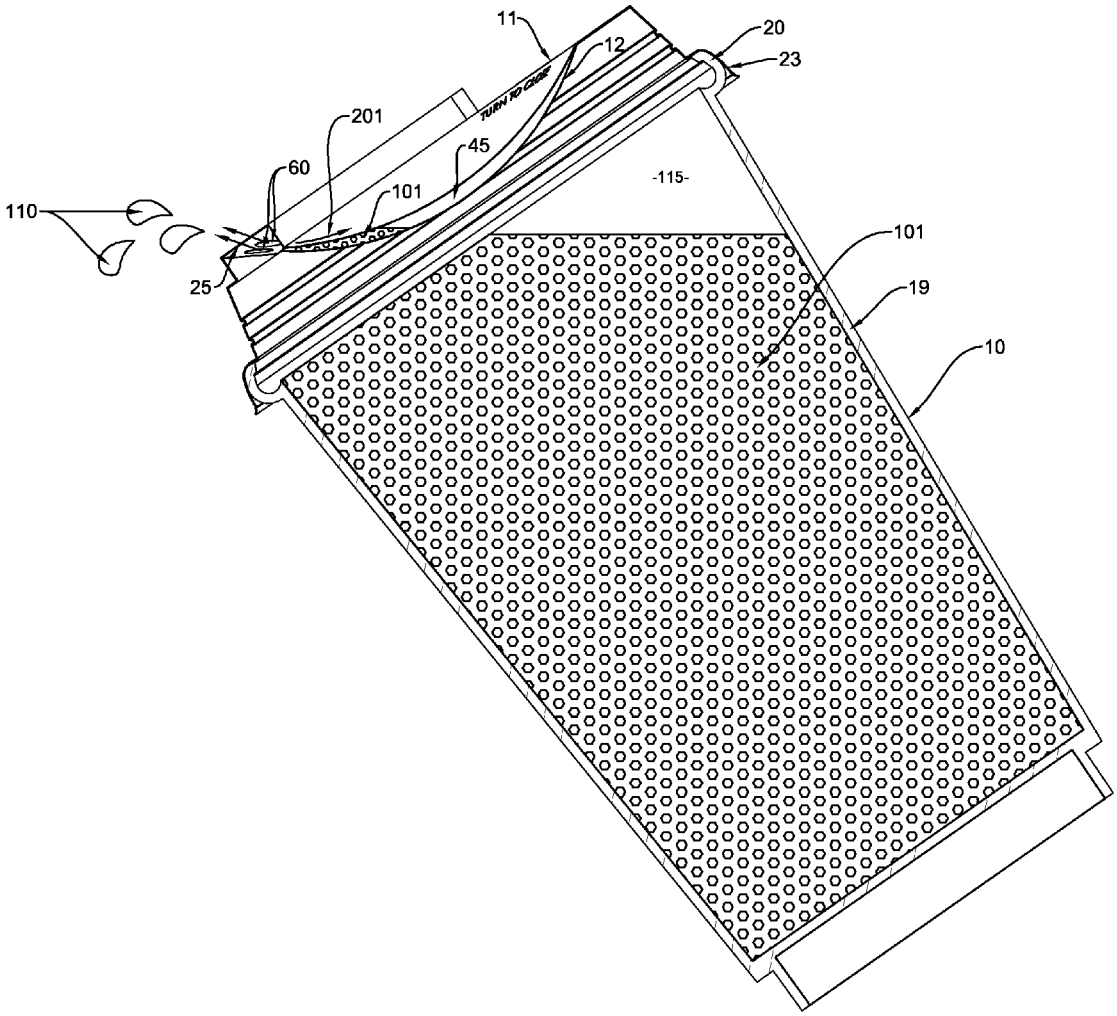

FIG. 25A is a second sequential diagrammatic longitudinal cross-sectional type depiction of a beverage container outfitted with the alternative lid-insert construction according to the present invention shown in a first angle of inclination off of a vertical orientation for inletting beverage via damming insert apertures into a beverage-cooling channel.

Figure 25B:
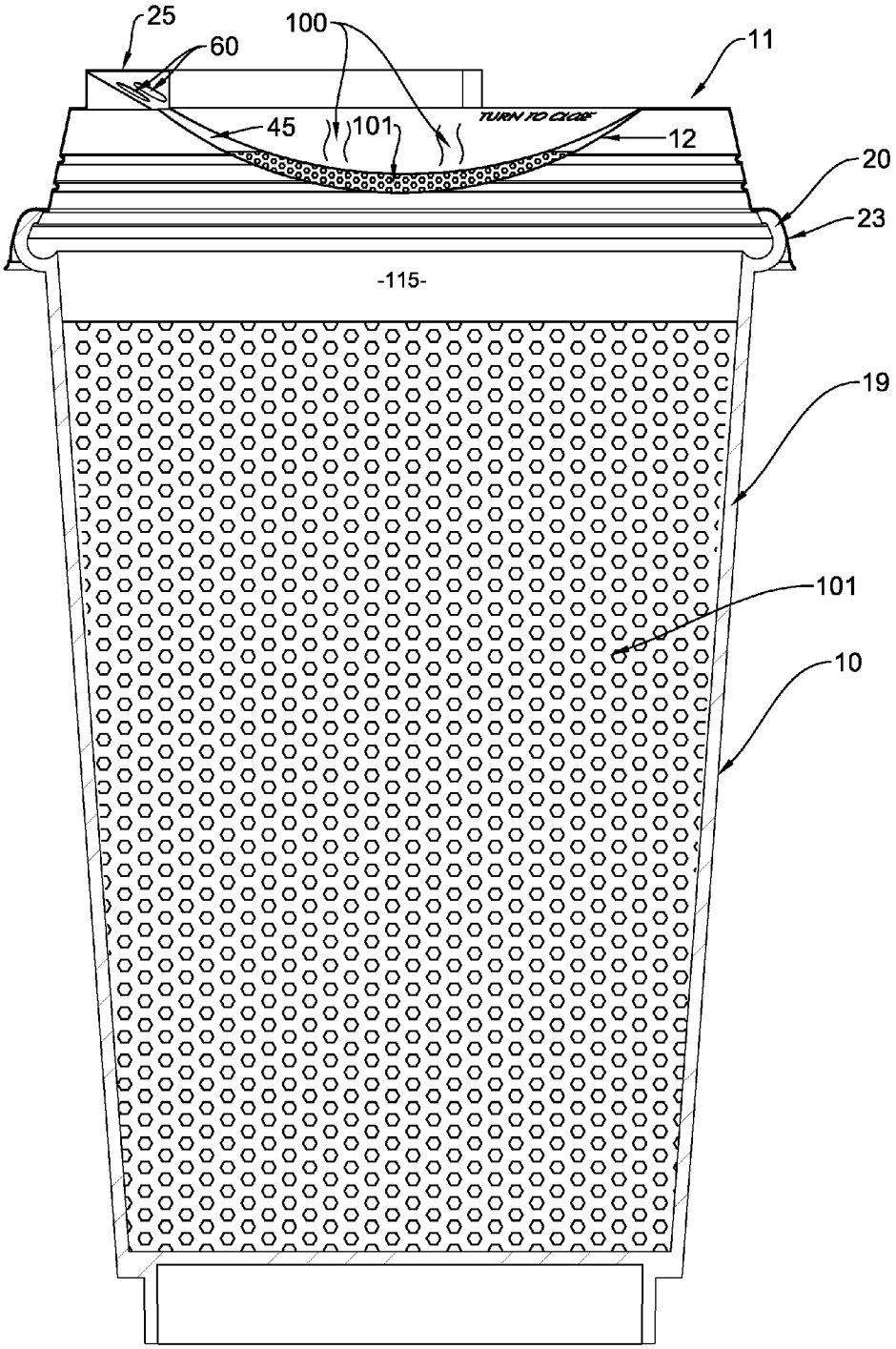

FIG. 25B is a third sequential diagrammatic longitudinal cross-sectional type depiction of a beverage container outfitted with the alternative lid-insert construction according to the present invention shown in a vertical orientation with beverage received and pooled within the beverage-cooling channel.

Figure 25C:
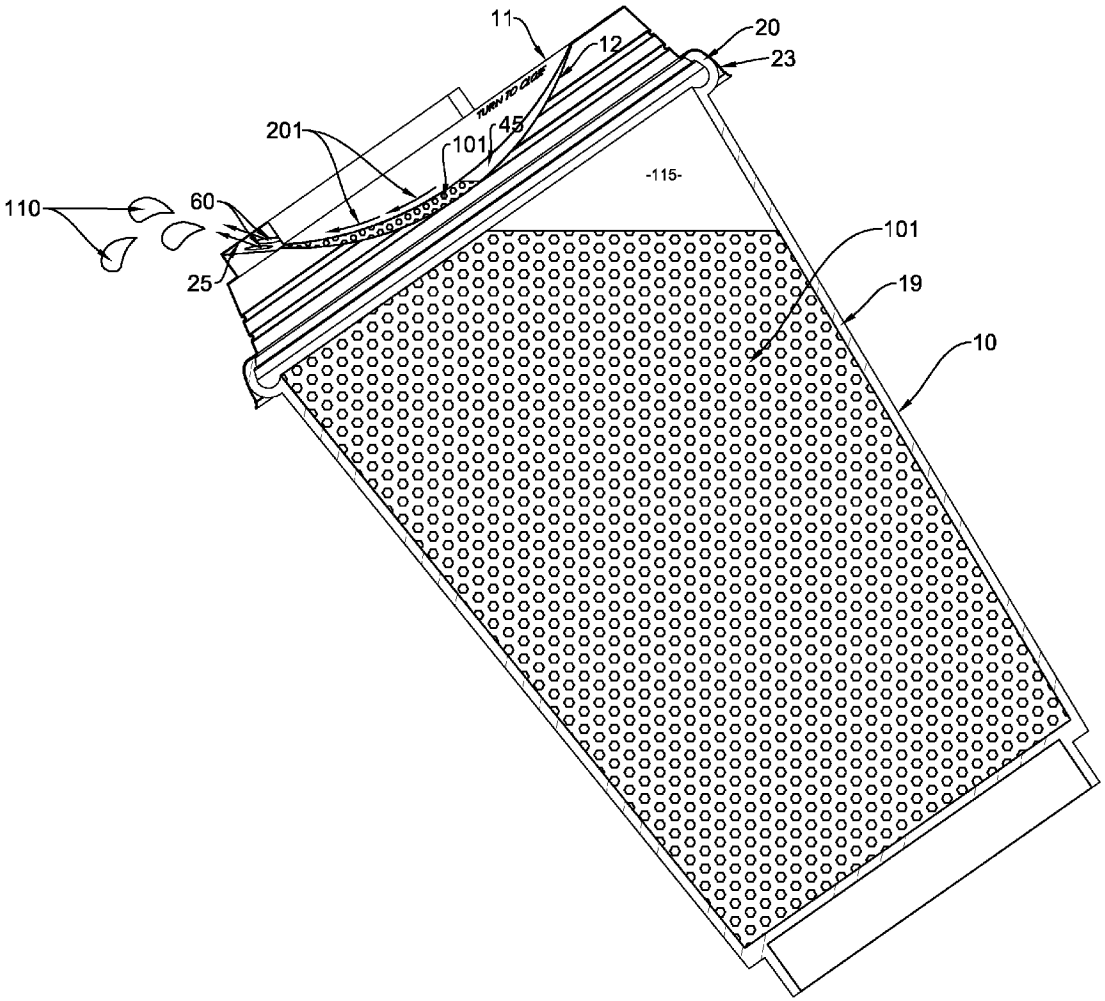

FIG. 25C is a fourth sequential diagrammatic longitudinal cross-sectional type depiction of a beverage container outfitted with the alternative lid-insert construction according to the present invention shown in an angle of inclination off of a vertical orientation for outletting cooled beverage via the primary beverage outlet.

Figure 26:
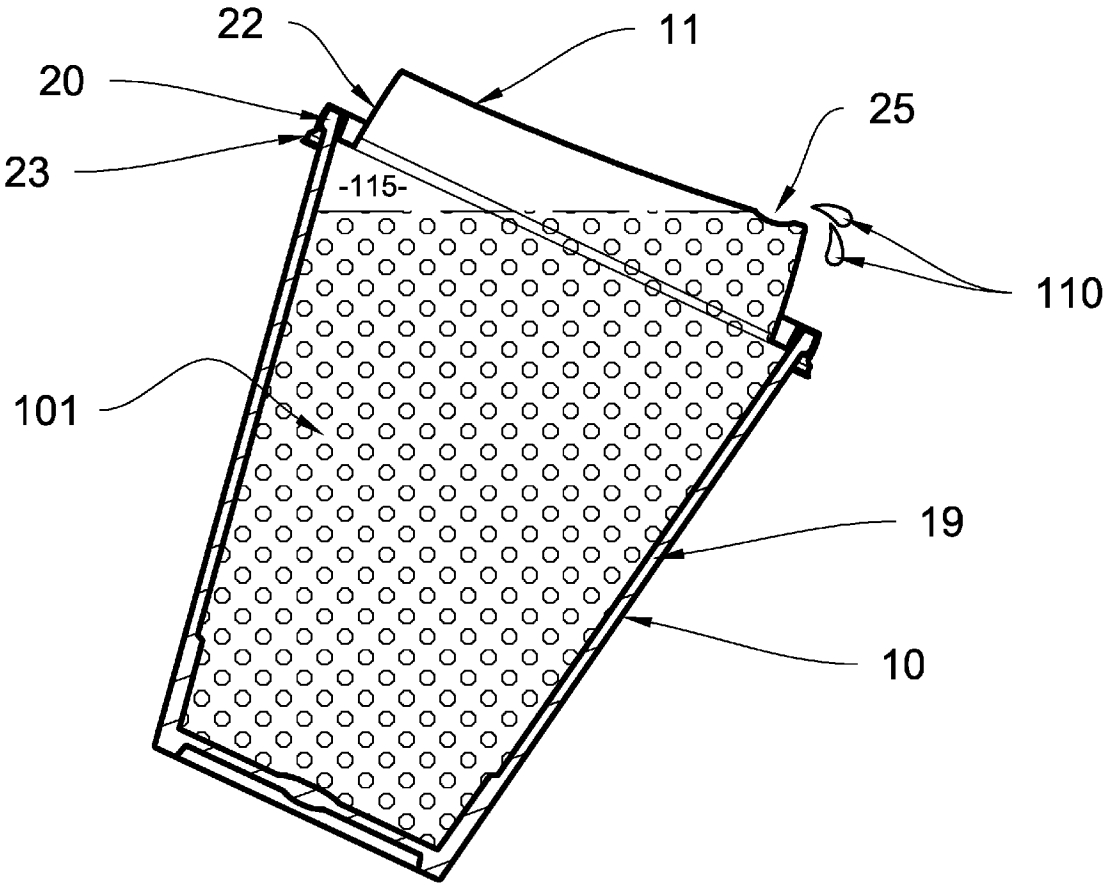

FIG. 26 is a first sequential diagrammatic longitudinal cross-sectional type depiction of a beverage container outfitted with a standard or generic state of the art lid construction shown in an angle of inclination off of a vertical orientation and depicting a relatively minor beverage flow from the primary beverage outlet.

Figure 27:
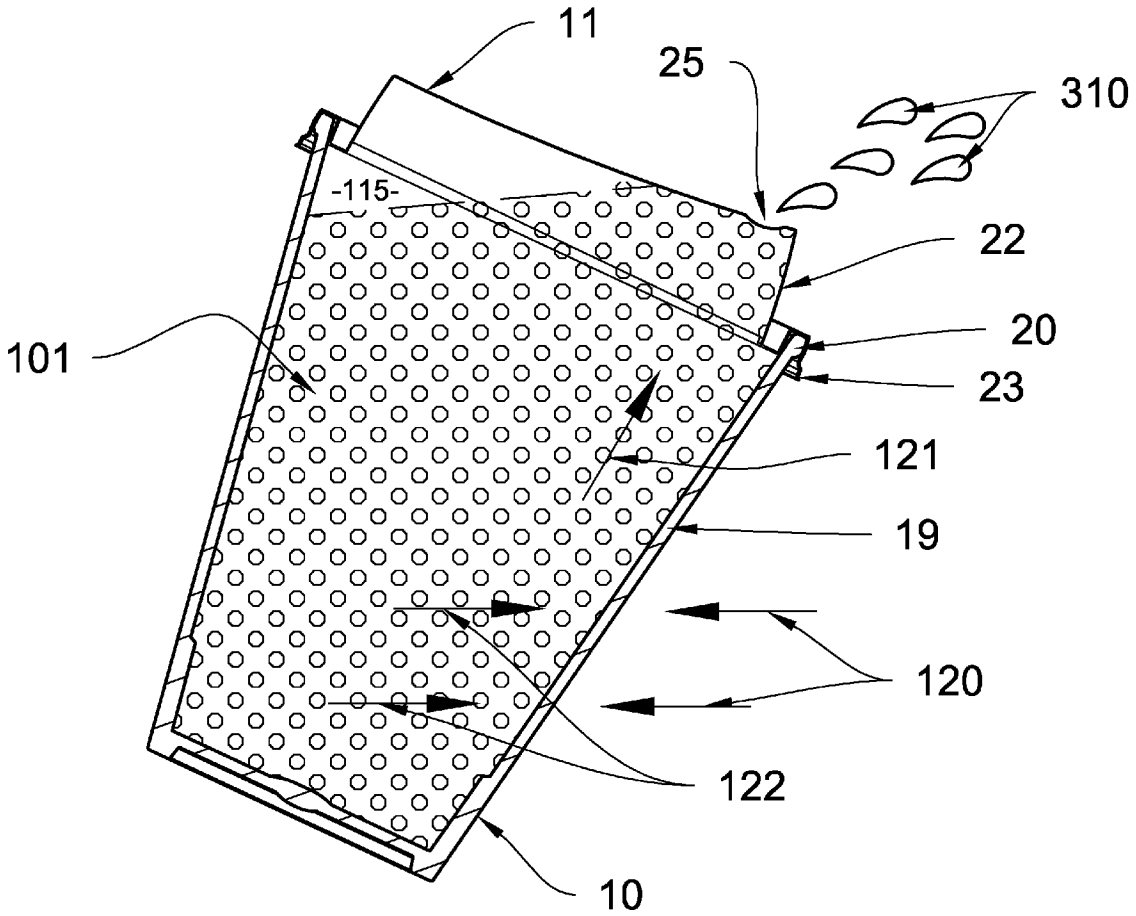

FIG. 27 is a second sequential diagrammatic longitudinal cross-sectional type depiction of a beverage container outfitted with a standard or generic state of the art lid construction shown in an angle of inclination off of a vertical orientation being accelerated to the left, the contained beverage being driven upwardly within the beverage containing compartment of the beverage container, the view depicting a relatively greater beverage flow from the primary beverage outlet in view of the acceleration.

Figure 28:
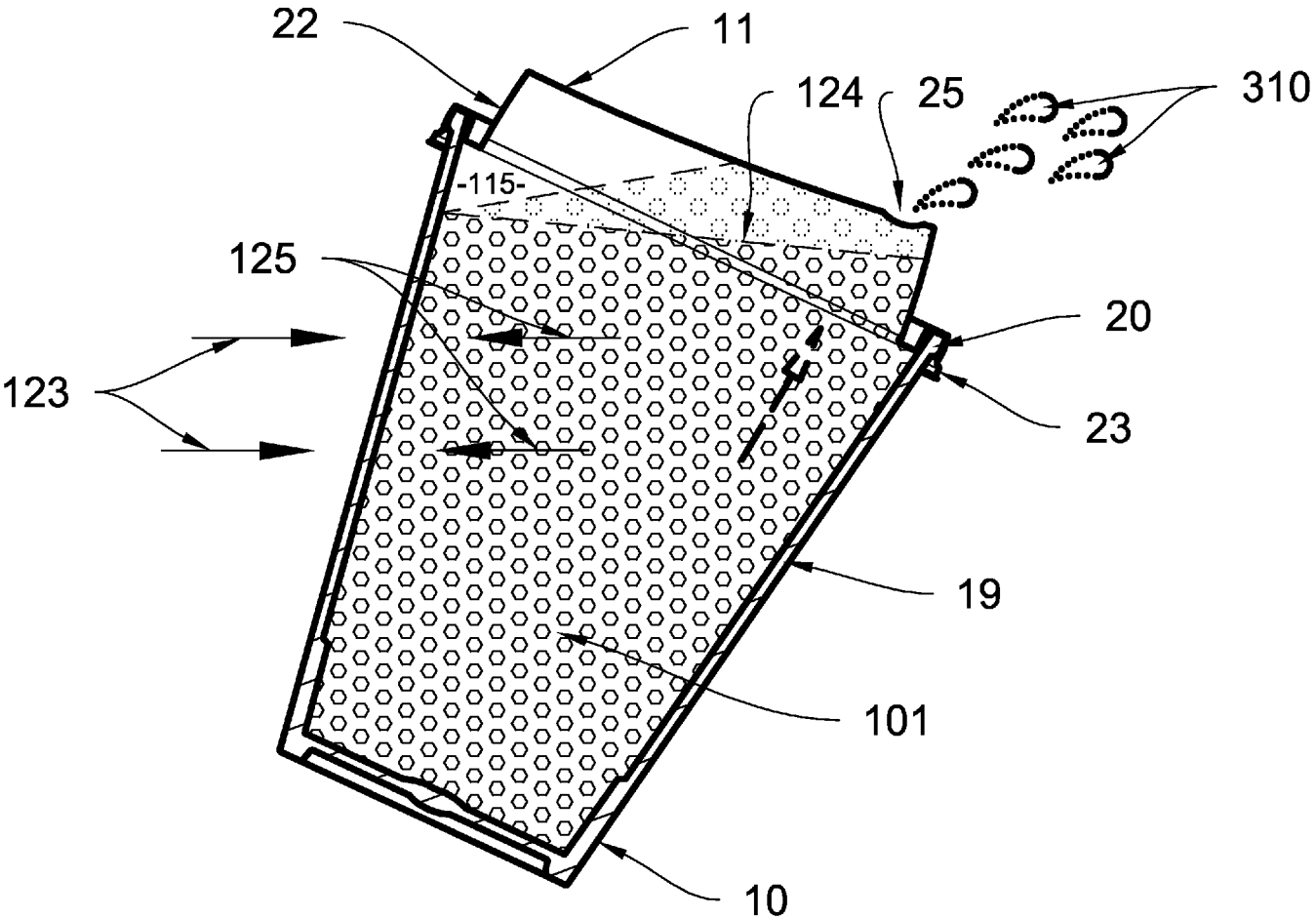

FIG. 28 is a third sequential diagrammatic longitudinal cross-sectional type depiction of a beverage container outfitted with a standard or generic state of the art lid construction shown in an angle of inclination off of a vertical orientation being accelerated to the right, the contained beverage being driven downwardly within the beverage containing compartment of the beverage container, the view depicting halted beverage flow from the primary beverage outlet in view of the reversed acceleration relative to FIG. 27.

Figure 29:
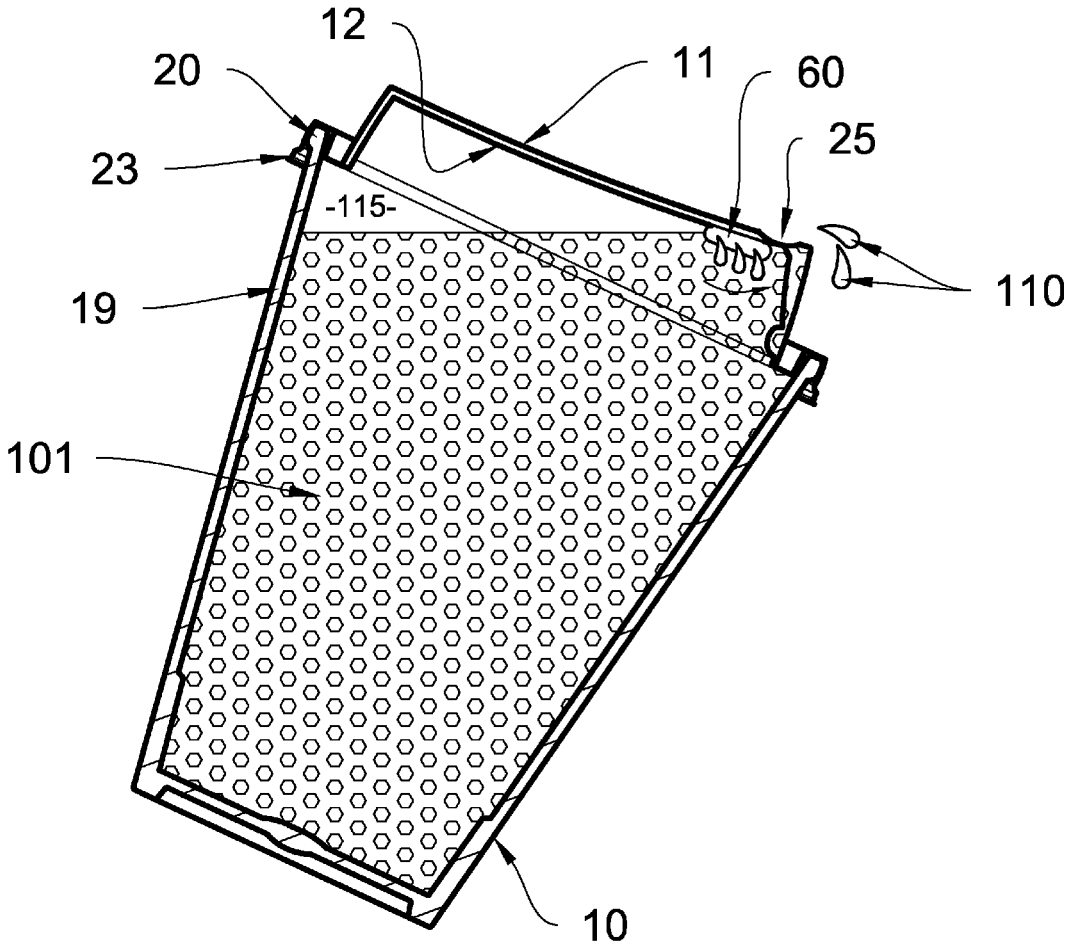

FIG. 29 is a fourth sequential diagrammatic longitudinal cross-sectional type depiction of a beverage container outfitted with a lid-insert combination or construction according to the present invention shown in an angle of inclination off of a vertical orientation and depicting a relatively minor or standard beverage flow from the primary beverage outlet.

Figure 30:
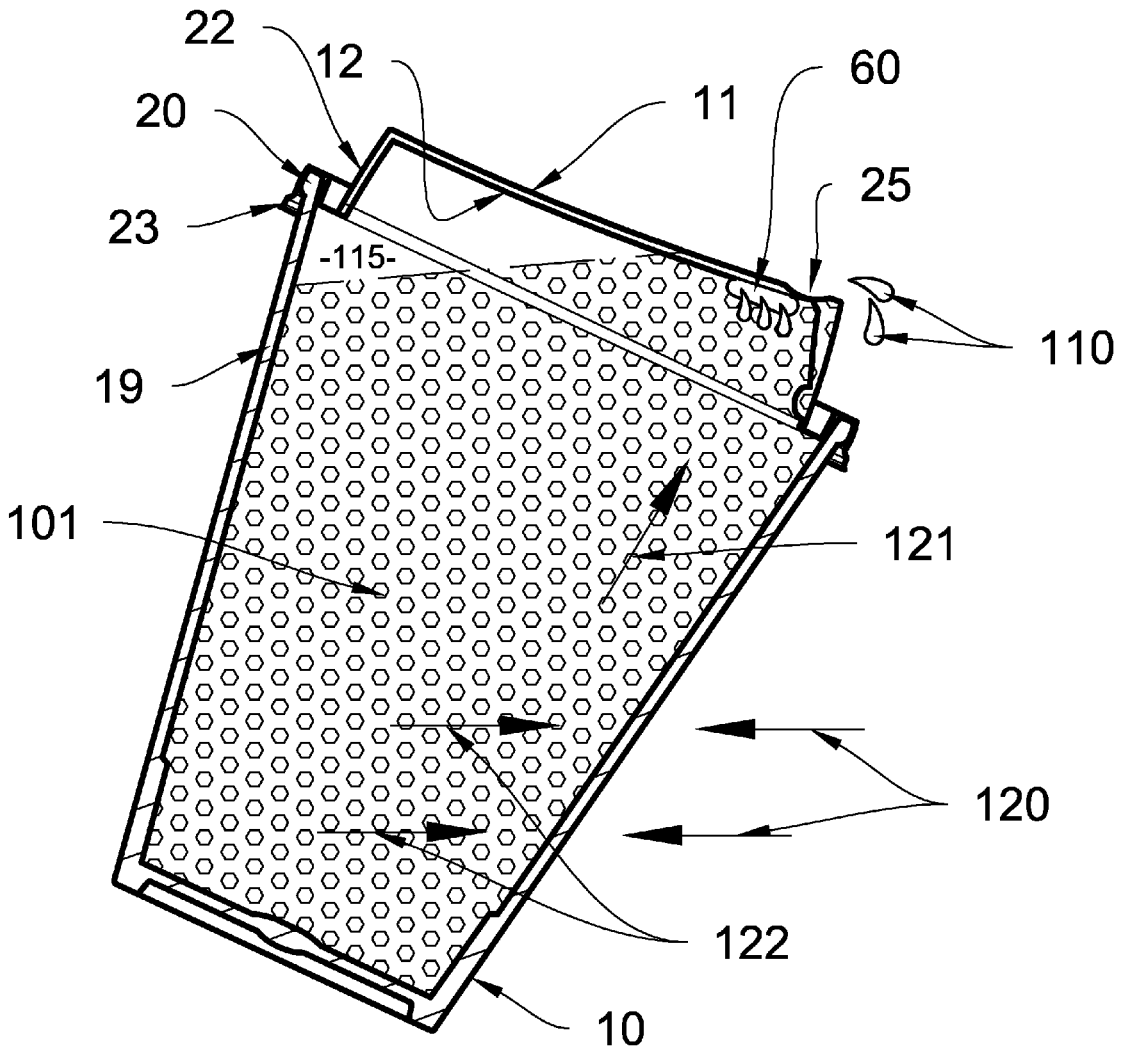

FIG. 30 is a fifth sequential diagrammatic longitudinal cross-sectional type depiction of a beverage container outfitted with a lid-insert combination or construction according to the present invention shown in an angle of inclination off of a vertical orientation being accelerated to the left, the contained beverage being driven upwardly within the beverage containing compartment of the beverage container, the beverage flow from the primary beverage outlet being restricted via the lid-insert combination or construction.

Figure 31:
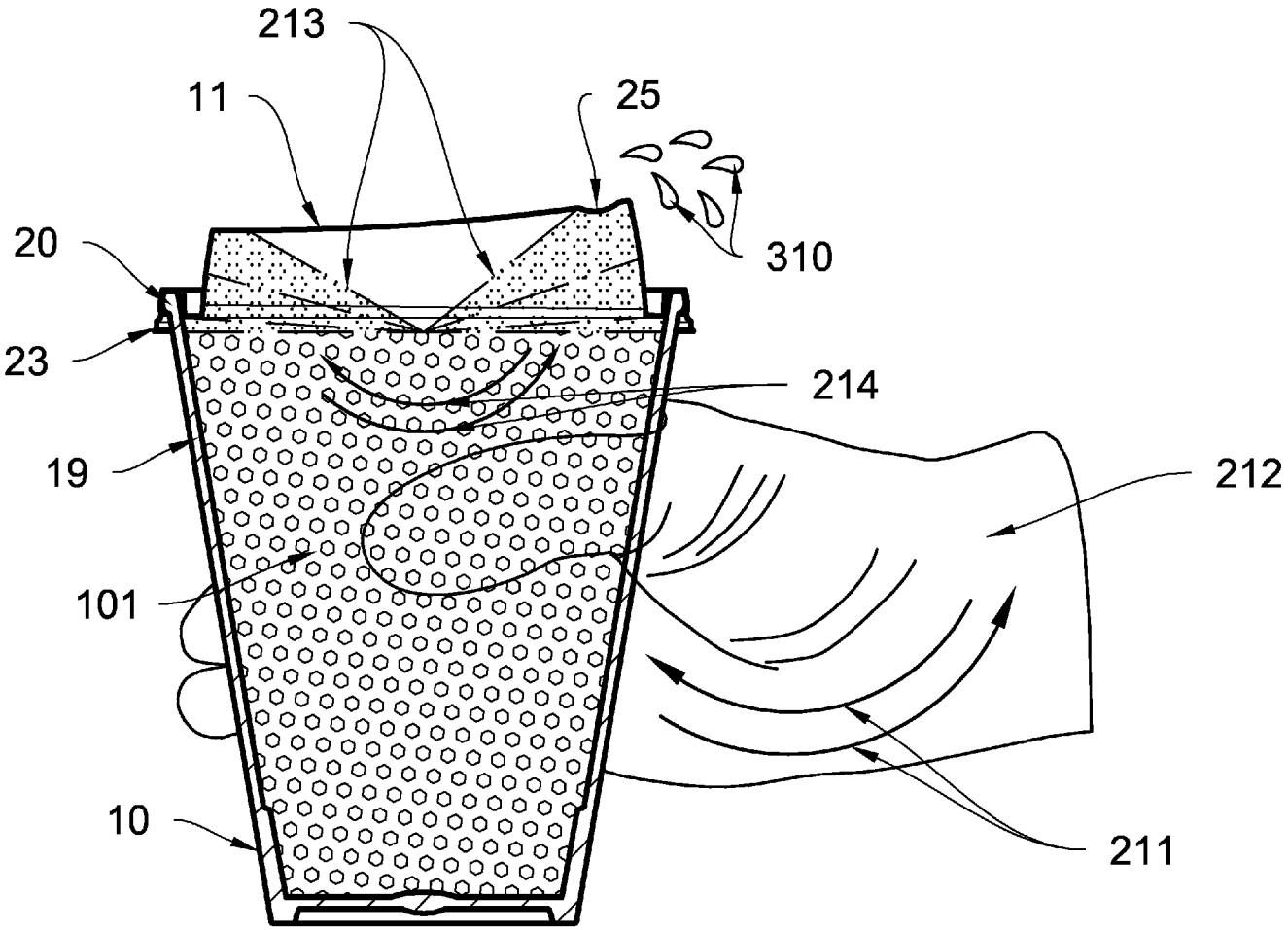

FIG. 31 is a sixth sequential diagrammatic longitudinal cross-sectional type depiction of a beverage container outfitted with a state of the art lid construction and shown in a vertical orientation and being rotatively oscillated via a user's fragmentary hand, the contained beverage being driven upwardly within the beverage containing compartment of the beverage container, the beverage flow from the primary beverage outlet being relatively great.

Figure 32:
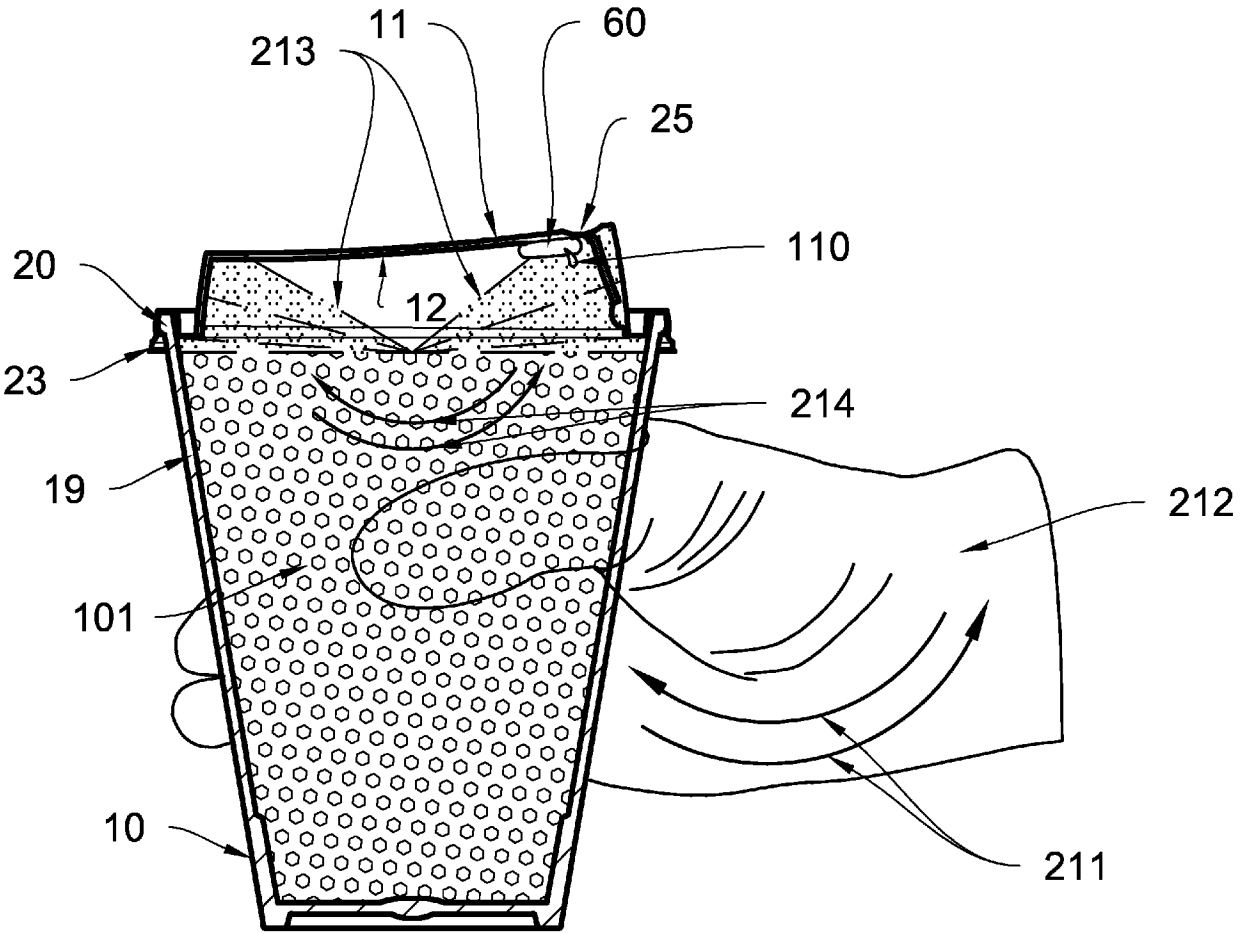

FIG. 32 is a seventh sequential diagrammatic longitudinal cross-sectional type depiction of a beverage container outfitted with a lid-insert combination or construction according to the present invention shown in a vertical orientation and being rotatively oscillated via a user's fragmentary hand, the contained beverage being driven upwardly within the beverage containing compartment of the beverage container, the beverage flow from the primary beverage outlet being restricted via the lid-insert combination or construction.

DETAILED DESCRIPTION OF PREFERRED EMBODIMENTS

Referring now to the drawings with more specificity, the preferred embodiments of the present invention primarily concern a hot beverage container lid construction for preventing inadvertent removal of the lid construction from a hot beverage container for preventing scalding of the user from accidentally spilled hot beverage or from too rapid a delivery of hot liquid from the container. In this last regard, a further objective of the present disclosures is to provide a lid construction or lid-insert type construction or assembly for enabling a user/drinker to effectively transfer heat (as generically referenced at 100) from a relatively hot assembly-contained beverage 101 so as to cool the beverage 101 before it enters the user's/drinker's mouth.

The present inventions and disclosures are thus contemplated to provide certain low-cost, disposable container-based lid and/or lid insert constructions as a preferred means for safeguarding a user or hot beverage consumer from accidental spillage of hot beverage 101 from a lid-outfitted beverage container. Further, the present inventions and disclosures are contemplated to provide certain low-cost, disposable container-based lid and/or lid insert constructions as a preferred means for transferring thermal energy from a relatively hot liquid beverage 101 to relatively cool surroundings before consumption to prevent scalding during the act of consuming a hot beverage.

Figure 1A:
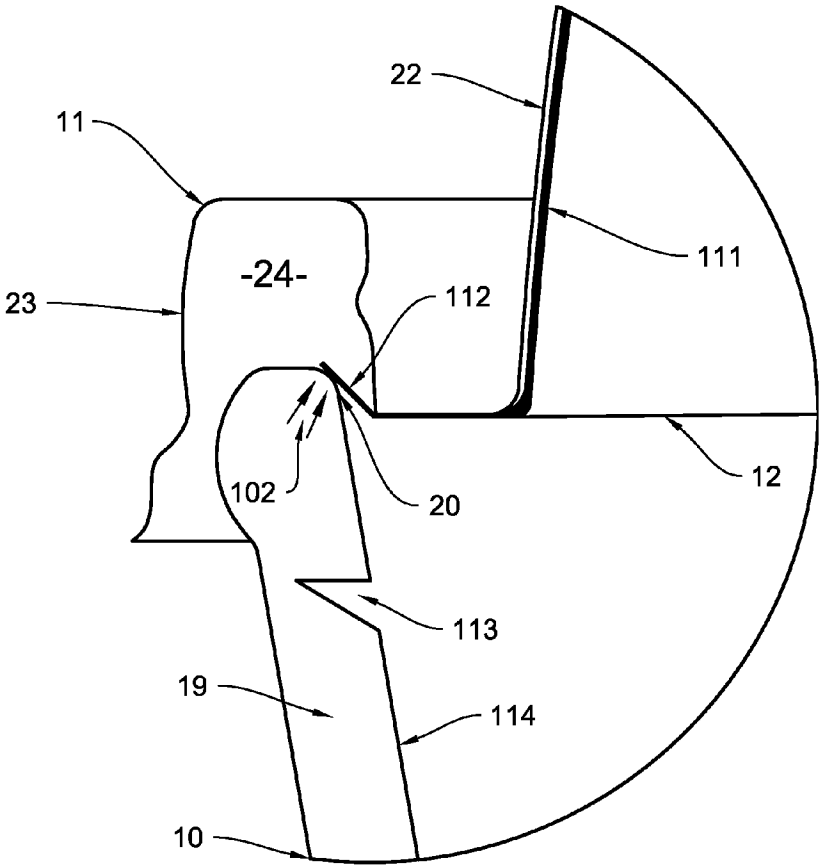
FIG. 1A is a fragmentary, first enlarged sectional view of the junction site at the generic lid-insert combination or construction according to the present invention and the first alternative beverage container as otherwise depicted in FIG. 1.
Figure 2A:
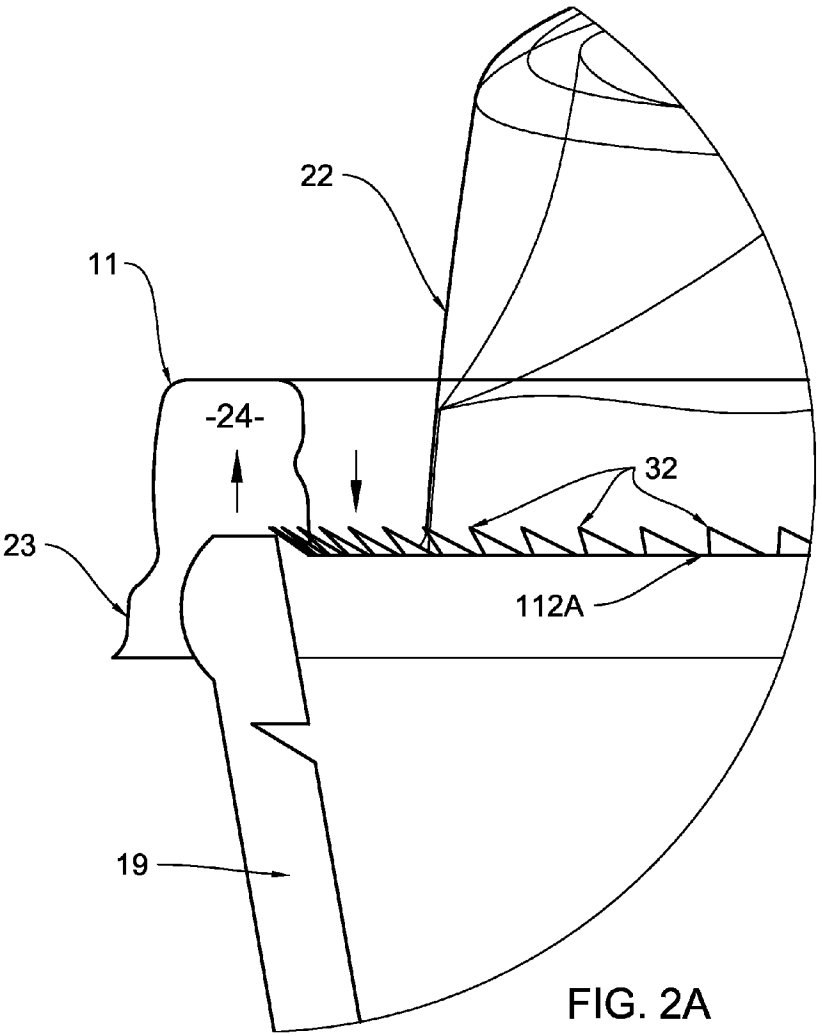
FIG. 2A is a fragmentary, first enlarged sectional view of the junction site at the first alternative lid-insert combination or construction according to the present invention and the first alternative beverage container as otherwise depicted in FIG. 2.
Figure 2:
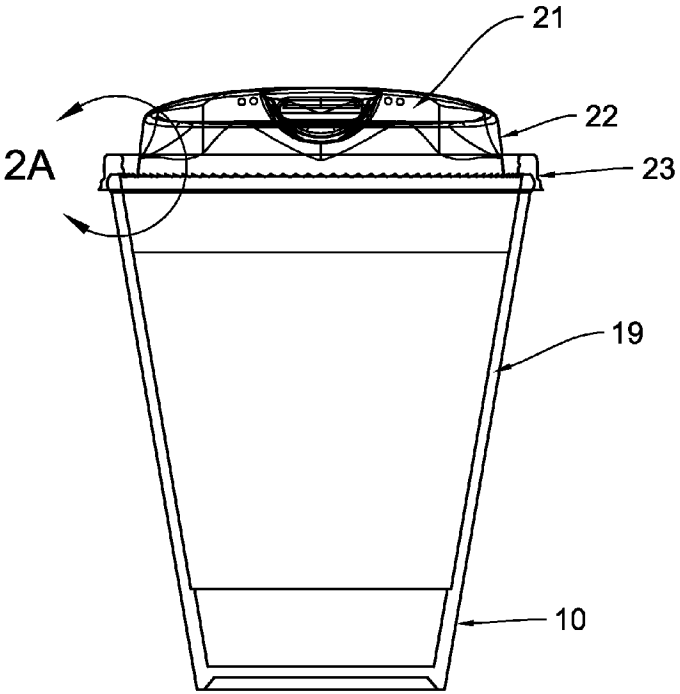
FIG. 2 is a longitudinal cross-sectional depiction of a first alternative lid-insert combination or construction according to the present invention positioned atop the first alternative beverage container before being attached to said first alternative beverage container.
Figure 3A:
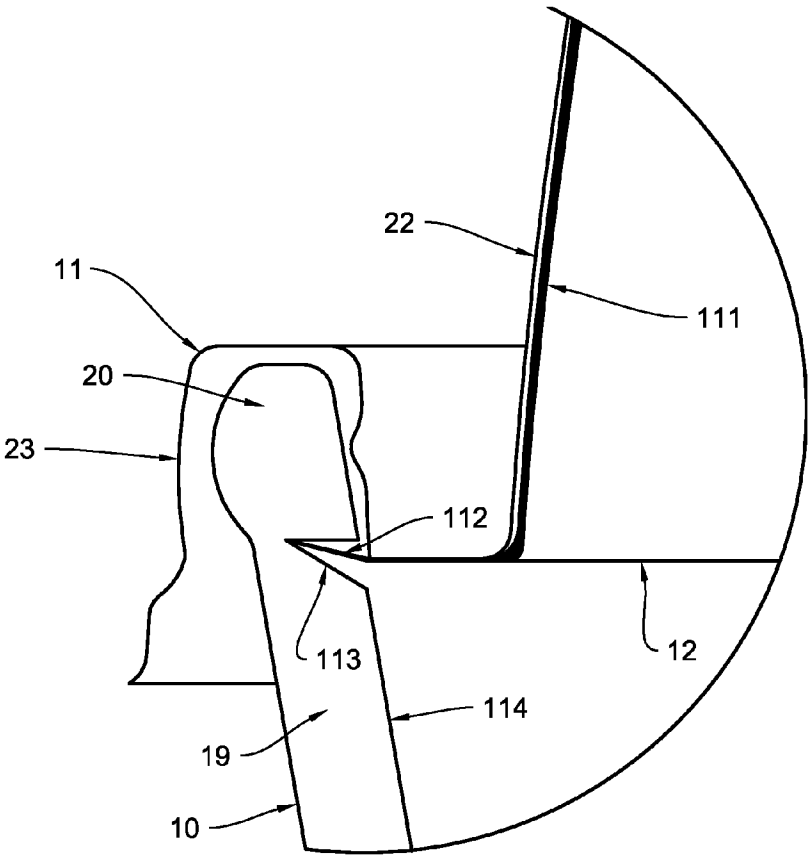
FIG. 3A is a fragmentary, enlarged sectional view of the junction site at the generic lid-insert combination or construction according to the present invention and the first alternative beverage container as otherwise depicted in FIG. 3.
Figure 3:
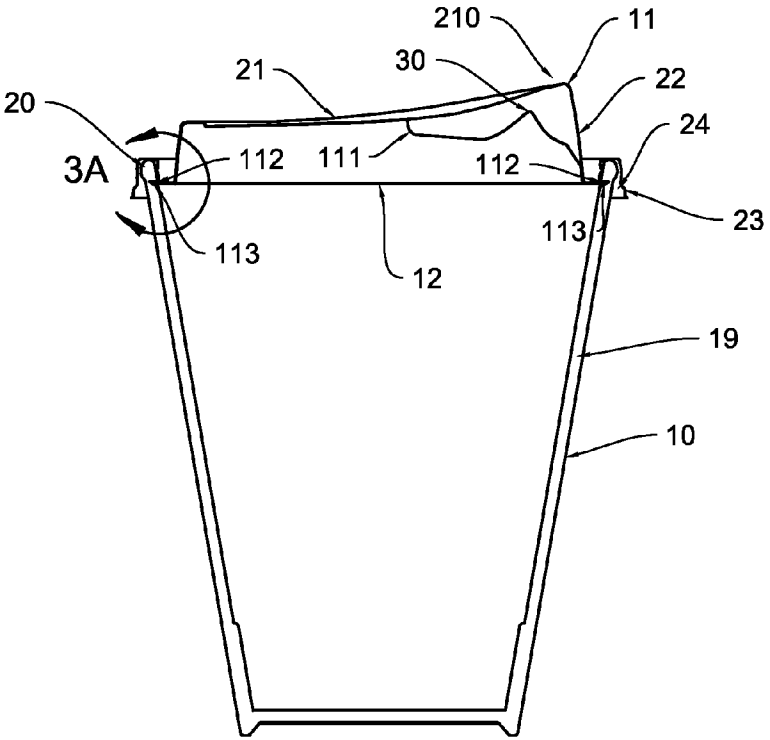
FIG. 3 is a second sequential longitudinal cross-sectional depiction of the generic lid-insert combination or construction according to the present invention positioned atop the first alternative beverage container after being attached to said first alternative beverage container.
Figure 3C:
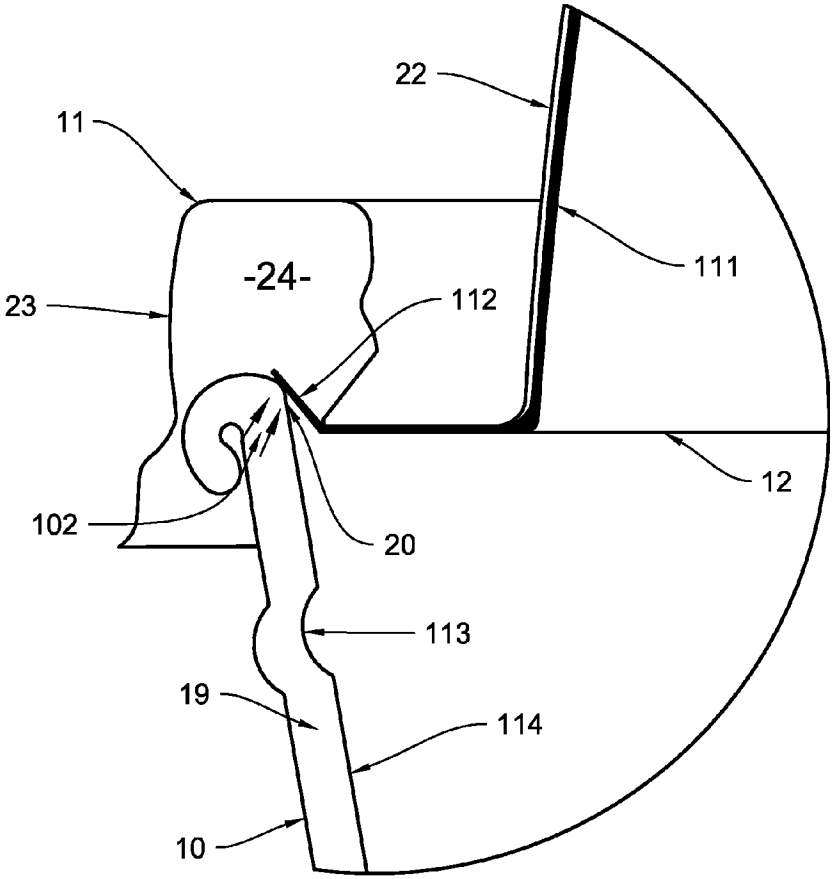
FIG. 3C is a fragmentary, enlarged sectional view of the junction site at the generic lid-insert combination or construction according to the present invention and the fourth alternative beverage container as otherwise depicted in FIG. 3B.
Figure 3B:
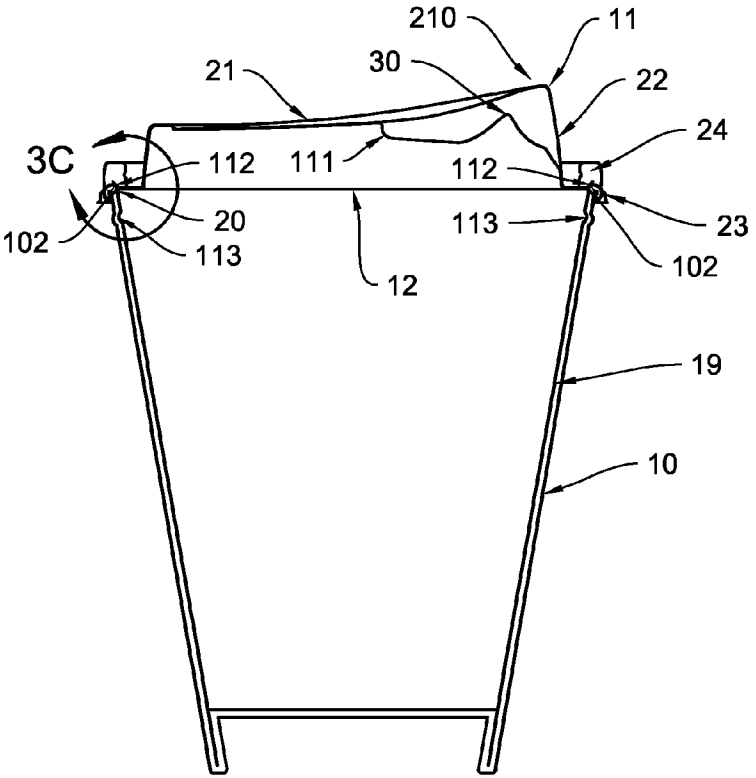
FIG. 3B is a longitudinal cross-sectional depiction of the generic lid-insert combination or construction according to the present invention positioned atop a fourth alternative beverage container before being attached to said fourth alternative beverage container.
Figure 3E:
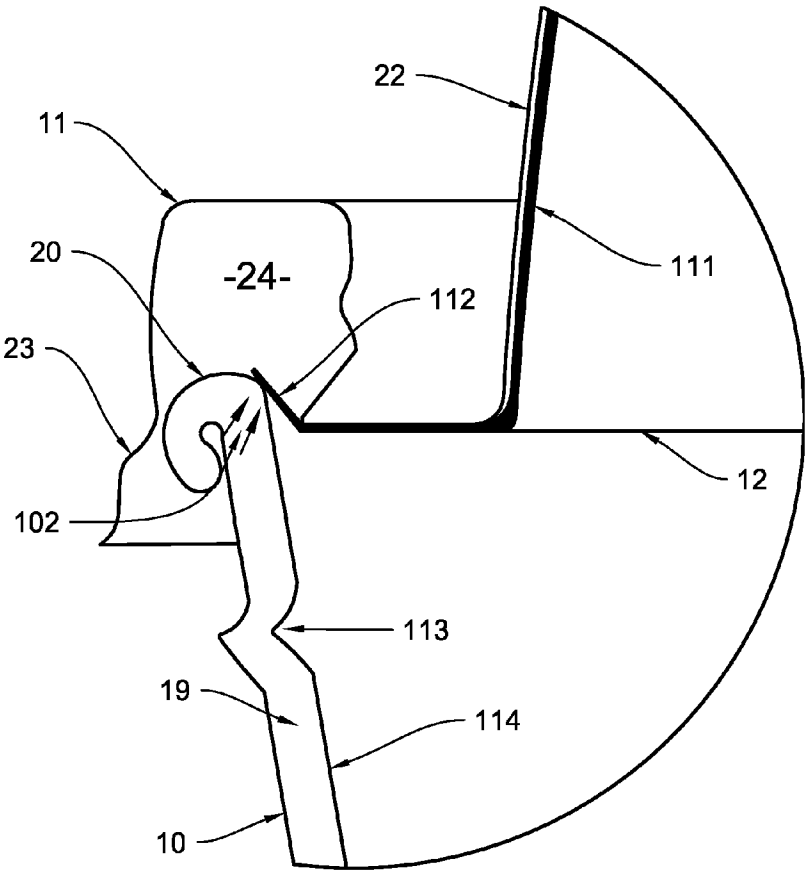
FIG. 3E is a fragmentary, enlarged sectional view of the junction site at the generic lid-insert combination or construction according to the present invention and the third alternative beverage container as otherwise depicted in FIG. 3D.
Figure 3D:
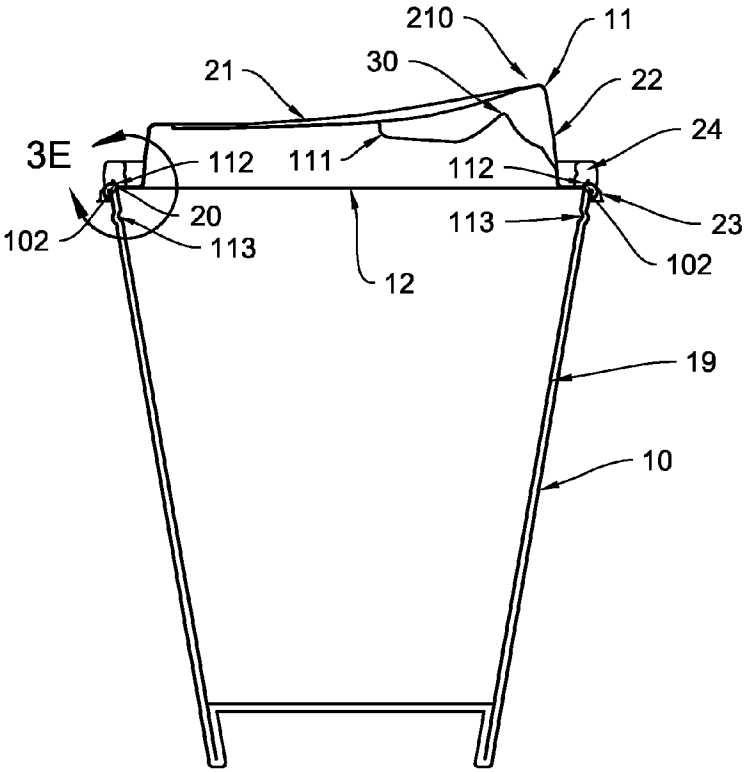
FIG. 3D is a first sequential, longitudinal cross-sectional depiction of the generic lid-insert combination or construction according to the present invention positioned atop the third alternative beverage container before being attached to said third alternative beverage container.
Figure 4B:
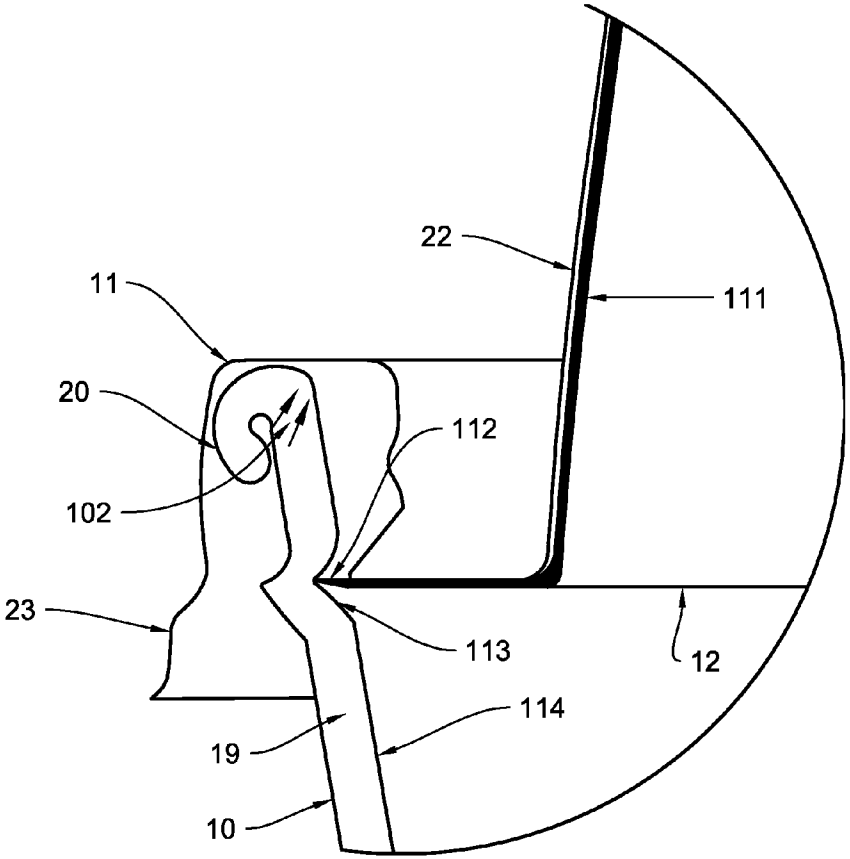
FIG. 4B is a fragmentary, enlarged sectional view of the junction site at the generic lid-insert combination or construction according to the present invention and the third alternative beverage container as otherwise depicted in FIG. 4A.
Figure 4A:
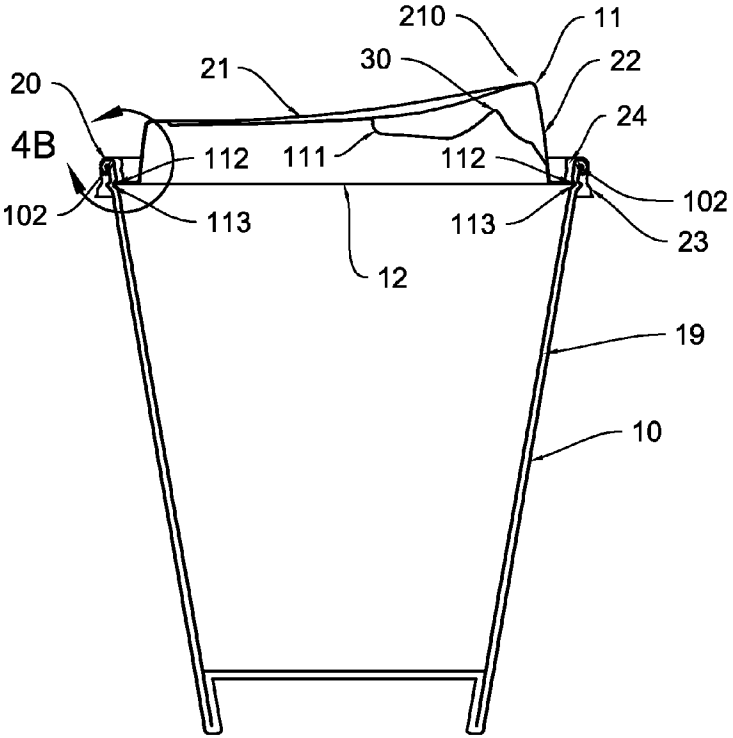
FIG. 4A is a second sequential, longitudinal cross-sectional depiction of the generic lid-insert combination or construction according to the present invention positioned atop the third alternative beverage container after being attached to said third alternative beverage container.

When viewed in combination with a hot beverage container assembly, the present invention is believed to comprise a container structure as at 10, a lid structure or construction as at 11, and an insert structure or construction as generally depicted and referenced at 12. The essential container structure 10 is believed to preferably comprise a container bottom, a container wall as at 19, and an upper container rim as at 20. It is contemplated that the container wall 19 may be preferably constructed from or comprise a polymeric foam type material as generally depicted in FIGS. 1A, 2A, and 3A; or a paper-based type material as generally depicted in FIGS. 3C, 3E, and 4B.

The lid structure or construction 11 is believed to preferably comprise a contoured lid top 21, a lid wall 22, and a lower lid rim 23 or means for receiving the upper container rim as preferably exemplified by a container rim-receiving groove 24. A lid peak is referenced at 210. Thus, the lower lid rim 23 receives or is otherwise attachably cooperable with the upper container rim 20. The contoured lid top 21 comprises a primary beverage outlet as at 25, which primary beverage outlet 25 may be of various sizes and configurations. It is contemplated, for example, that the primary beverage outlet 25 may be circular of differing diameters. Other outlet shapes are contemplated, however, such as oval outlets or generally rectangular outlets as generally depicted throughout the illustrations being submitted in support of these specifications.

As prefaced above, the present invention is primarily intended as a means of addressing beverage movement during the act of walking with a contained beverage. During walking conditions with a beverage container in hand, oscillations attendant to movements tend to force beverage out of the container causing potentially injurious beverage spills. The lid insert construction according to the present invention may thus be said to provide certain beverage-oscillation damping means for damping beverage oscillations within the beverage container and preventing spillage of the beverage.

If the beverage contained is sufficiently hot, injury to the container carrier can result of the lid were to become removed from the container and the contents spilled. A primary object of the present invention is thus to prevent burn-related injury to container carriers, and thus the lid-insert combination or construction comprising a lid element 11 and an insert element 12 with its attendant beverage damming features and the lid-to-container gripping means function to prevent inadvertent spillage of container contents such as hot beverage from the assembly during assembly movements and/or accelerations.

To help illustrate one of the primary objectives of the present invention, the reader is directed to FIGS. 26-32. FIG. 26 is a first sequential diagrammatic longitudinal cross-sectional type depiction of a beverage container 10 outfitted with a standard or generic state of the art type lid construction 11 shown in an angle of inclination off of a vertical orientation and depicting a relatively minor or standard beverage flow as at 110 from the primary beverage outlet 25 with the assembly in a non-accelerated, beverage-consuming state.

Referencing FIG. 27 and comparing FIG. 27 to FIG. 26, the reader will note that FIG. 27 is a second sequential diagrammatic longitudinal cross-sectional type depiction of the beverage container 10 outfitted with a standard or generic state of the art lid construction as at 11 shown in an angle of inclination off of a vertical orientation and being accelerated to the left (vectors 120 showing leftward acceleration), the contained beverage 101 being driven to the right (as at vectors 122) relative to the container wall 19.

Noting that a body at rest tends to stay at rest, the left-directed and accelerated container wall engages the contained beverage 101, and the contained beverage 101 is driven upwardly (as at vector 121) within the beverage containing compartment 115 of the beverage container 10 due to interference with the container wall 19. The view in FIG. 27 thus attempts to depict a relatively greater beverage flow as at 310 from the primary beverage outlet 25 in view of the container acceleration to the left as at vectors 120.

Moving on to FIG. 28, the reader will note that FIG. 28 is a third sequential diagrammatic longitudinal cross-sectional type depiction of the beverage container 10 as outfitted with a standard or generic state of the art lid construction 11 shown in the same angle of inclination off of a vertical orientation, but being accelerated to the right (or decelerated from acceleration 120) as at vectors 123. Again, noting that bodies at rest tend to stay at rest, the container wall 19 engages the contained beverage 101, and the contained beverage 101 is driven leftwardly as at vectors 125 and upwardly (as at vector 124) within the beverage containing compartment 115 of the beverage container 10 due to interference with the container wall 19. The view in FIG. 28 thus attempts to depict increased beverage flow as at drops 310 from the primary beverage outlet 25 in view of the container acceleration to the right as at vectors 123.

FIG. 29 is a fourth sequential diagrammatic longitudinal cross-sectional type depiction of a beverage container 10, this time outfitted with a generic lid-insert combination or construction according to the present invention shown in the same angle of inclination off of a vertical orientation and depicting a relatively minor or standard beverage flow 110 from the primary beverage outlet 25. The lid outfitted with a beverage-damming insert as at 12 allows the user or consumer to consume beverage flow 110 in a standard manner, but also prevents spillage given beverage container accelerations.

Referencing FIG. 30, and comparing FIG. 30 to FIG. 29, the reader will note that the beverage flow 110 is the same, despite beverage container acceleration as at vectors 120. The contained beverage 101 is again driven upwardly within the beverage containing compartment 115 of the beverage container, but prevented from exhibiting a relatively greater beverage flow (instead showing a standard beverage flow 110 as in FIG. 29) from the primary beverage outlet 25 in view of the lid-insert combination or construction with an inner or lower insert element as at 12 being outfitted or otherwise cooperably associated with an outer or upper lid element as at 11.

Referencing FIG. 31, the reader will there see a sixth sequential diagrammatic longitudinal cross-sectional type depiction of a beverage container outfitted with a state of the art lid construction and shown in a vertical orientation, but being rotatively oscillated (as at arrows 211 and 214) via a user's fragmentary hand 212. This type of movement is a diagrammatic representation of the types of movements that occur during a walking activity when a drinker is holding a contained beverage in hand. The contained beverage 101 is accordingly driven upwardly as at arrows 213 within the beverage containing compartment of the beverage container 10, the beverage flow 310 from the primary beverage outlet 25 being relatively greater or more rapid.

Comparing FIG. 31 versus FIG. 32, the reader will note that the latter figure is a depiction of a beverage container 10 outfitted with a lid-insert combination or construction according to the present invention shown in a vertical orientation and being rotatively oscillated as at arrows 211 and 214 via a user's fragmentary hand 212. The contained beverage 101 is again driven upwardly as at 213 within the beverage containing compartment of the beverage container 10, and the beverage flow 110 from the primary beverage outlet 25 is restricted via the damming insert apertures 60, thereby diverting liquid flow into the flow channel(s) 45 thereby preventing beverage from uncontrollably entering the primary beverage outlet and/or spillage therefrom. The lid insert construction according to the present invention may thus be said to provide certain beverage-redirection means for redirecting beverage movements away from the primary beverage outlet to prevent beverage spillage.

Central to the practice of the present invention are the various insert constructions as generically referenced at element 12 of the lid-insert combination. It is contemplated that the insert constructions 12 may be preferably separately attachable to or with (state of the art) lid construction(s) 11, although it is not inconceivable that lower insert-type or insert-mimicking constructions be integrally formed with upper or outer lid constructions as an alternative.

More particularly, the generic or preferred insert structure or construction 12 preferably comprises or provides a beverage-damming, inner or lower material layer or structure as at 111 (for forming beverage-cooling channels 45 within the lid construction) and an annular inner container wall-engaging, lid-to-wall locking structure or container-to-lid interface assembly (for locking the overall lid construction or assembly to the container construction) as generically referenced at 112.

Figure 6:
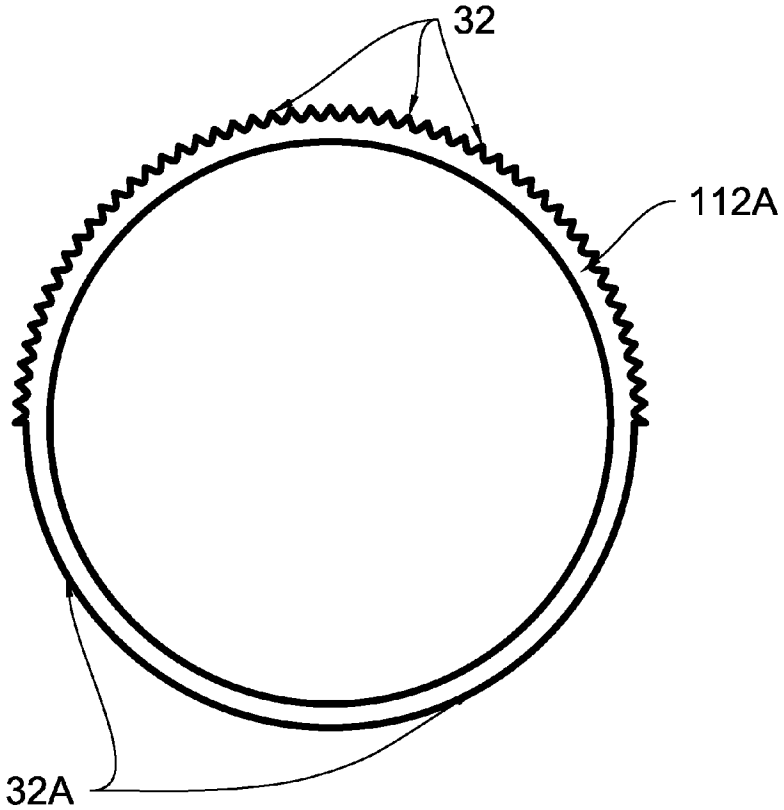
FIG. 6 is a diagrammatic perspective type depiction of the first (alternative) type of annular, wall-engaging structure according to the present invention showing a semicircular scalloped or serrated, annular, wall-engaging configuration.
Figure 5:
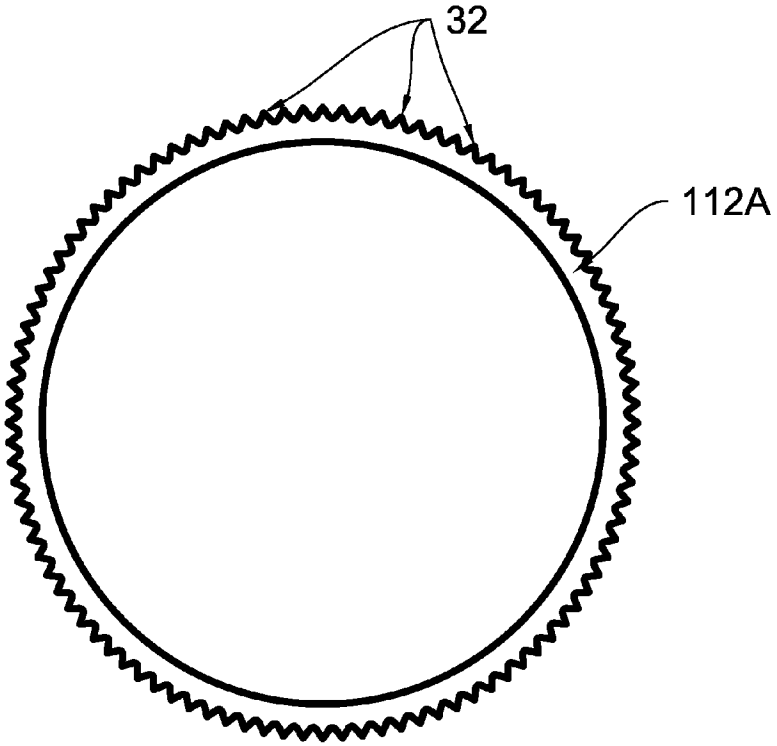
FIG. 5 is a diagrammatic plan type depiction of a first type of annular, wall-engaging structure according to the present invention showing a scalloped or continuously serrated, annular, wall-engaging configuration.
Figure 7:
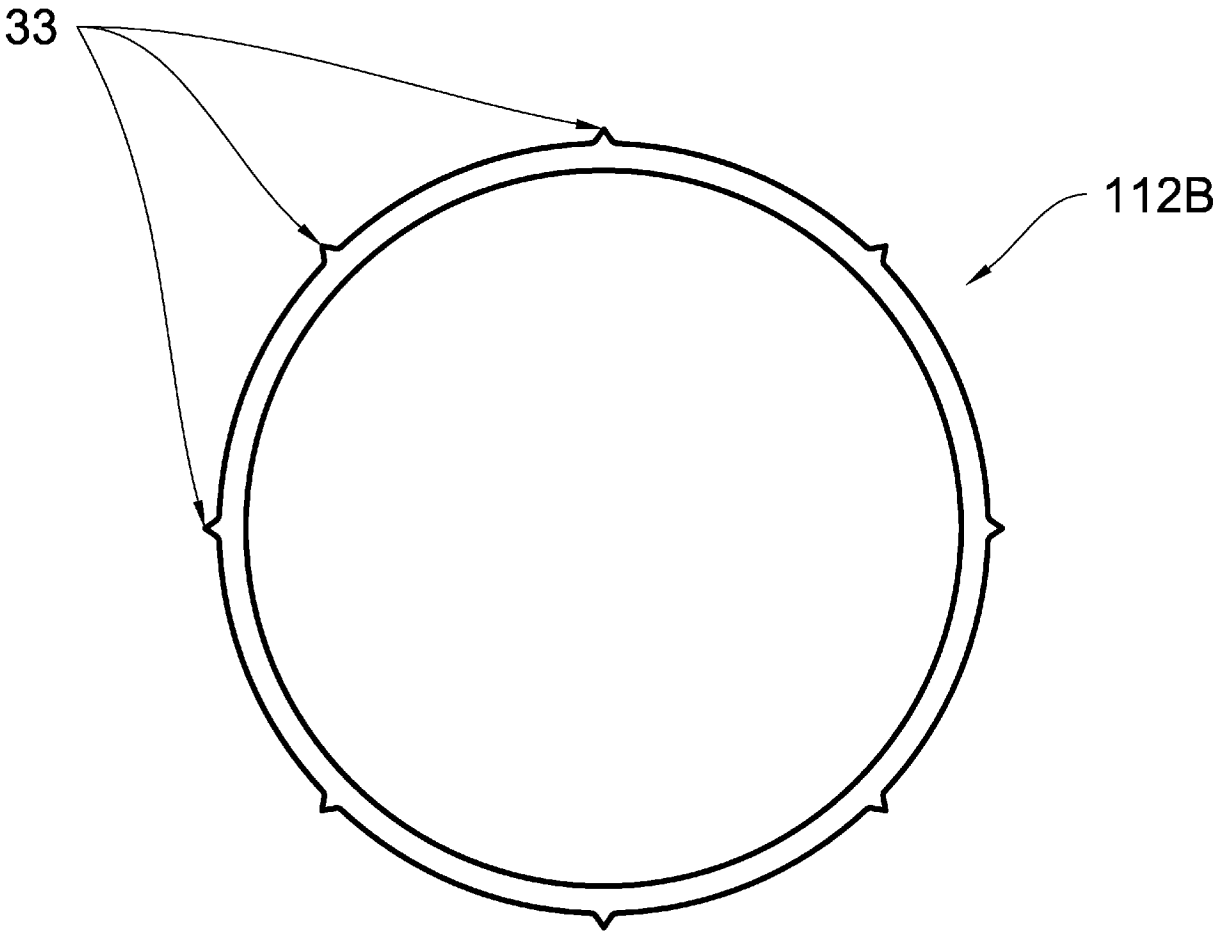
FIG. 7 is a diagrammatic plan type depiction of a second type of annular, wall-engaging structure according to the present invention showing a periodically or circumferentially spaced pointed or triangular pattern of the annular, wall-engaging configuration.

A number of alternative lid-to-wall locking structures 112 are contemplated as being embraced by the present specifications. For example, a continuously scalloped or serrated annular inner wall-engaging lid-to-wall locking structure is depicted in FIGS. 5 and 6 as at 112A. The structure, element, or feature 112A comprises a series of continuous serrations or radial projections as at 32. An alternative, periodic or circumferentially spaced annular inner wall-engaging lid-to-wall locking structure is depicted in FIG. 7 at 112B. The periodic serrations or pointed radial projections of lid-to-wall locking structure 112B are depicted and referenced at 33.

Figure 8:
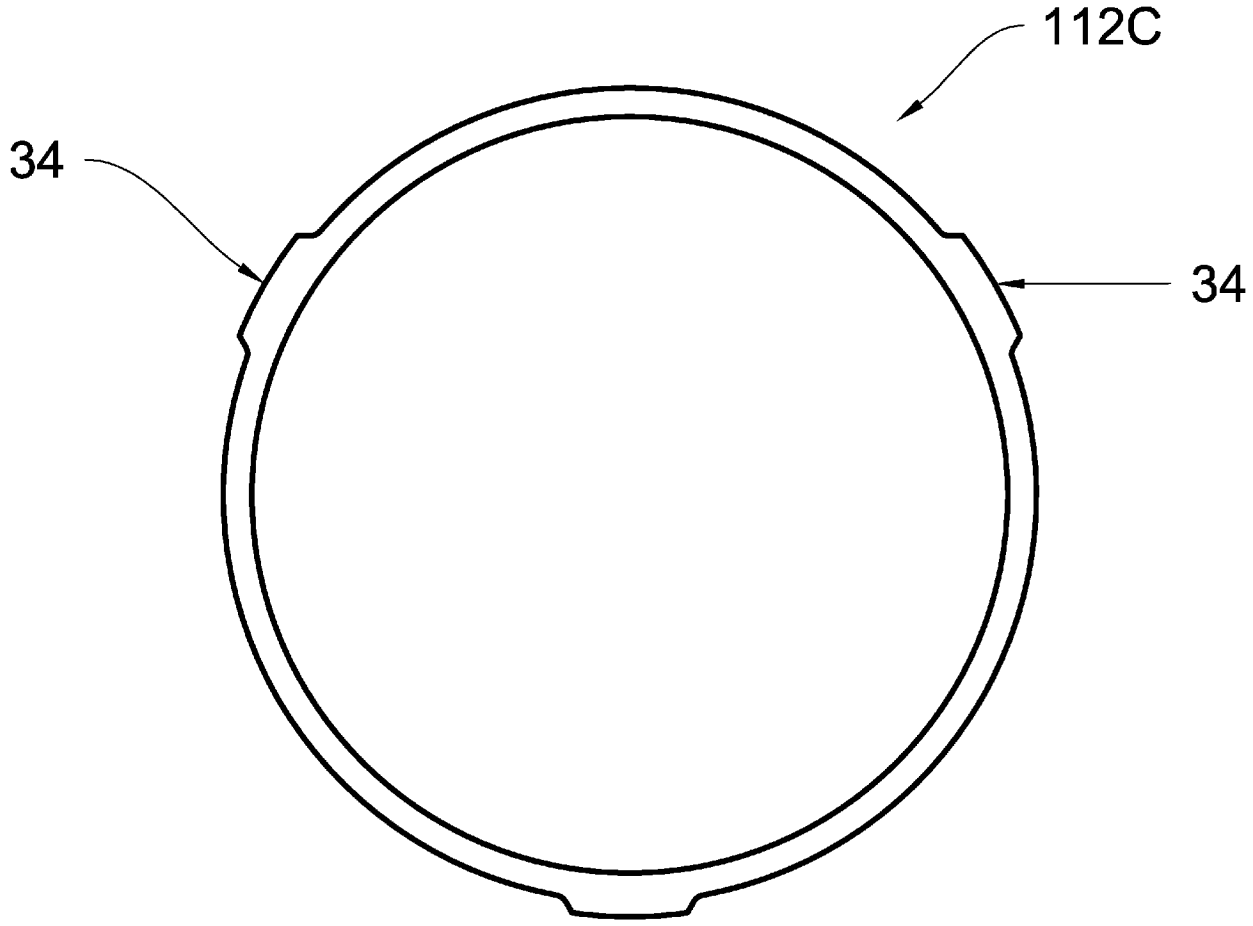
FIG. 8 is a diagrammatic plan type depiction of a third type of annular, wall-engaging structure according to the present invention showing a periodically or circumferentially spaced trapezoidal pattern of the annular, wall-engaging configuration.

Another alternative periodic or circumferentially spaced annular inner container wall-engaging lid-to-wall locking structure is depicted in FIG. 8 at 112C. The periodic trapezoidal type radial projections of said lid-to-wall locking structure 112C are depicted and referenced at 34. An annular inner container wall-engaging lid-to-wall locking structure is depicted in FIG. 9 and referenced at 112D. The lid-to-wall locking structure 112D comprises a solid, circumferential, radially-extending flange type extension or projection as depicted and referenced at 35. The projections 32-35 engage the container wall 19 as at 102, which engagement 102 forces the structures 112 into locked engagement with the inner container surfacing 114.

Figure 1:
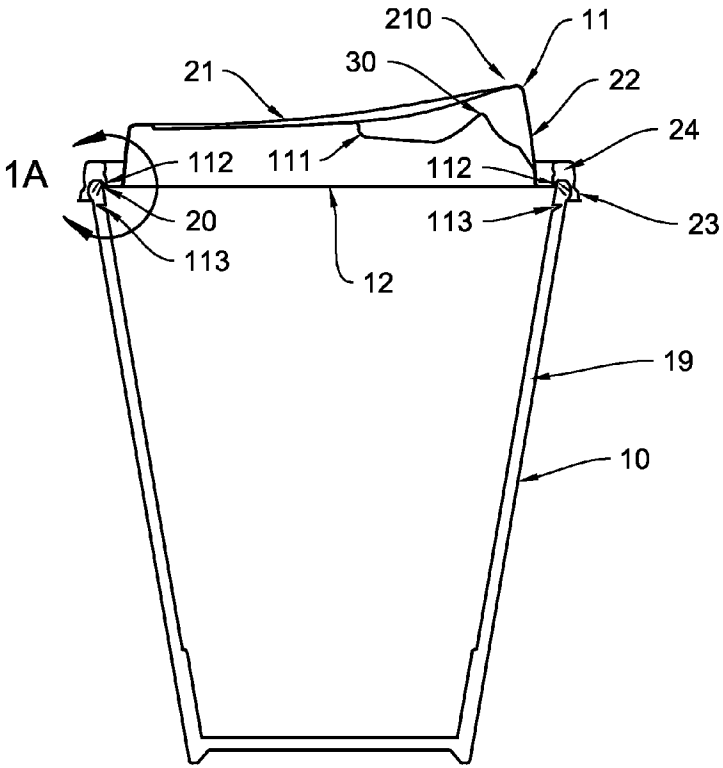
FIG. 1 is a first sequential longitudinal cross-sectional depiction of a generic lid-insert combination or construction according to the present invention positioned atop a first alternative beverage container before being attached to said first alternative beverage container.
Figure 1B:
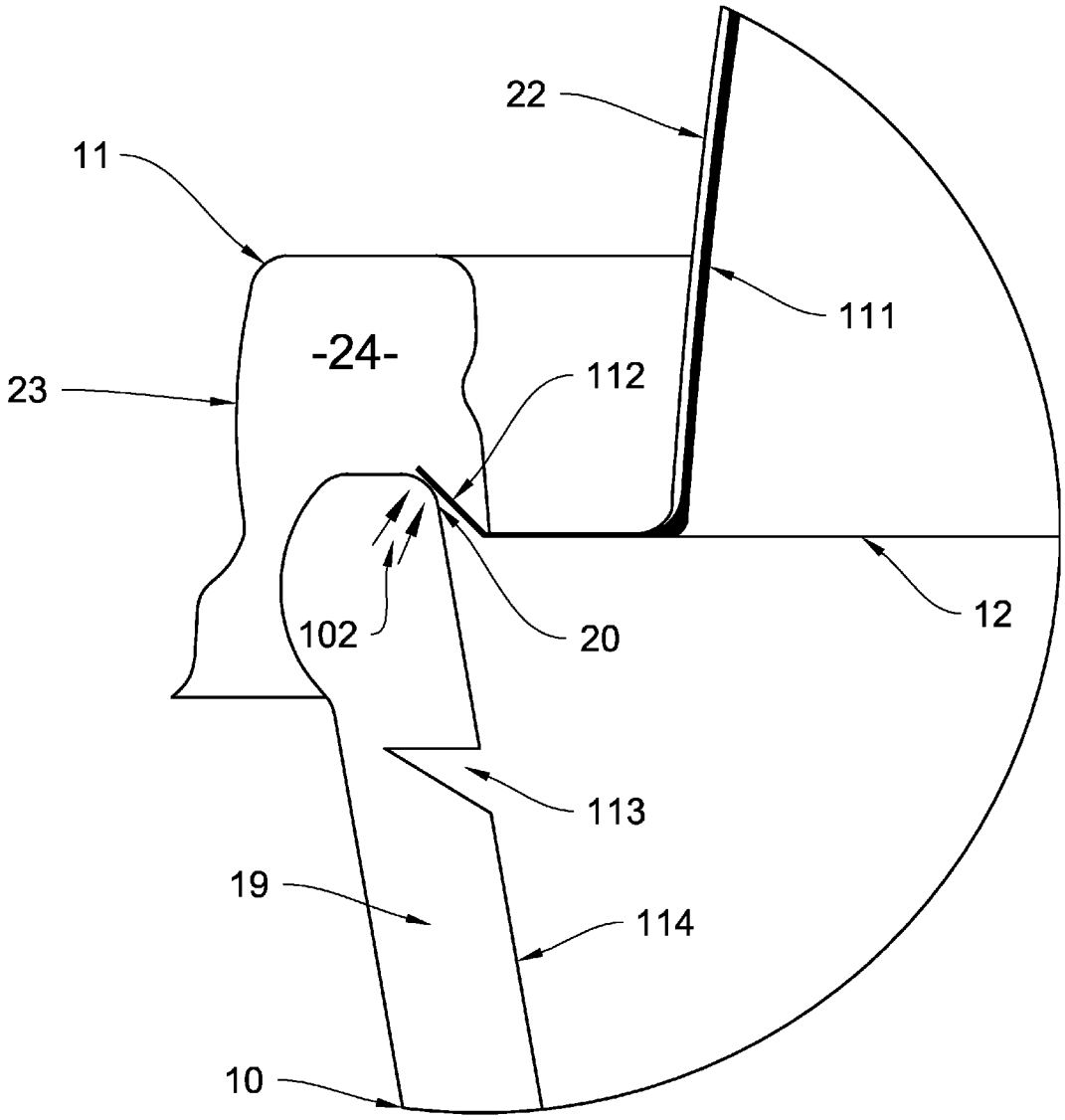
FIG. 1B is a fragmentary, second enlarged sectional view of the junction site at the generic lid-insert combination or construction according to the present invention and the first alternative beverage container as otherwise depicted in FIGS. 1 and 1A.
Figure 2C:
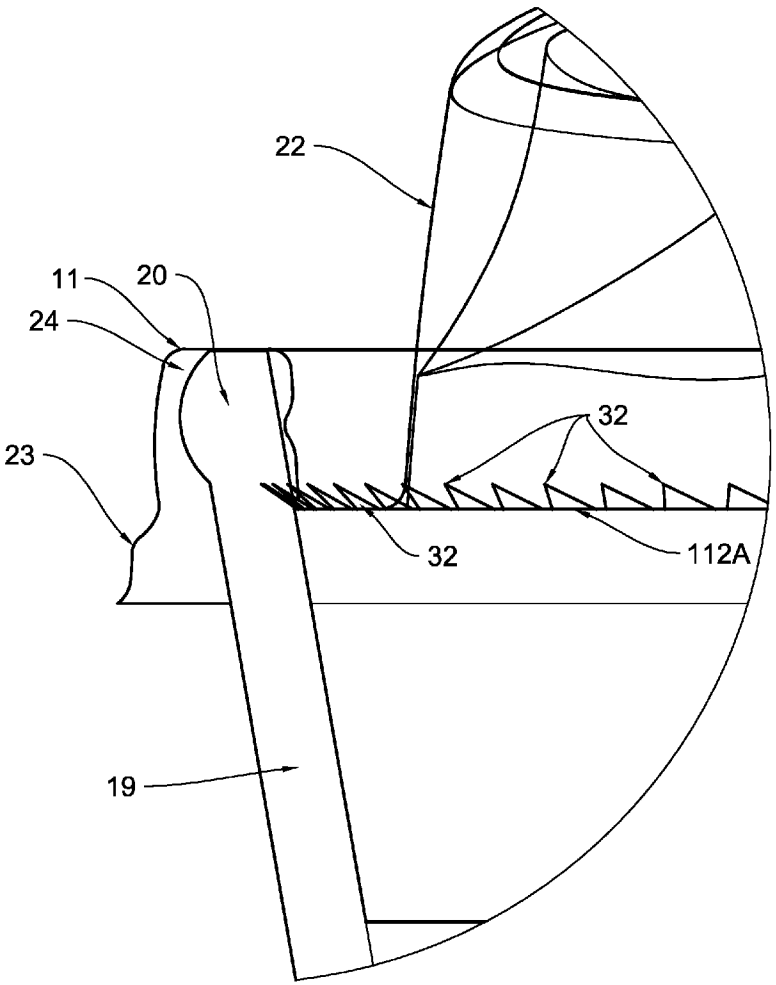
FIG. 2C is a fragmentary, first enlarged sectional view of the junction site at the first alternative lid-insert combination or construction according to the present invention and the second alternative beverage container as otherwise depicted in FIG. 2B.
Figure 2B:
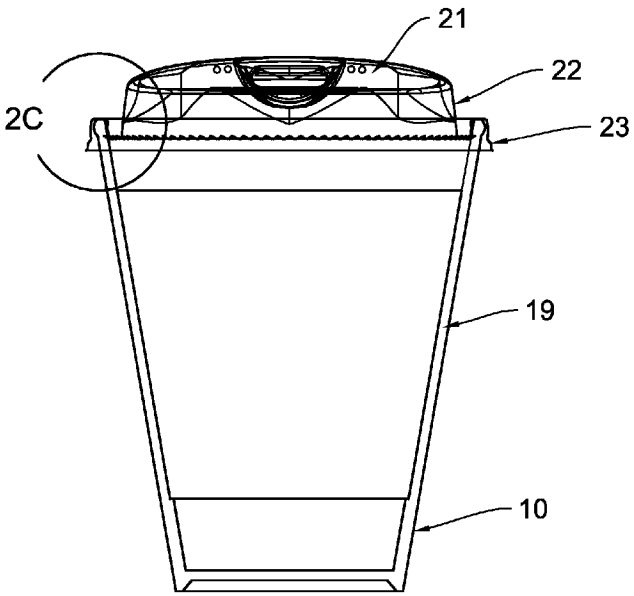
FIG. 2B is a longitudinal cross-sectional depiction of the first alternative lid-insert combination or construction according to the present invention attached to a second alternative beverage container.
Figure 2D:
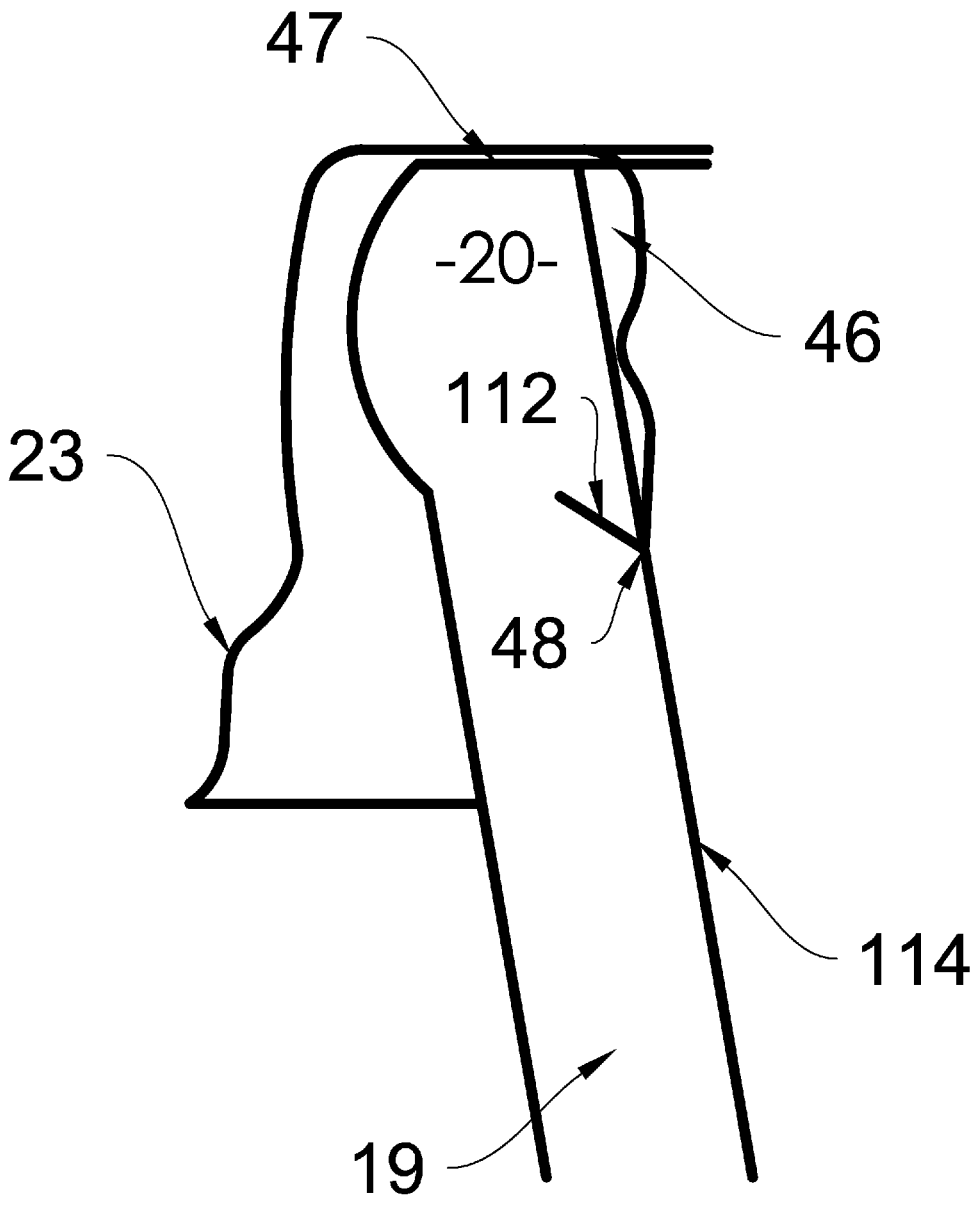
FIG. 2D is a fragmentary, enlarged sectional view of the junction site at the generic lid-insert combination or construction according to the present invention and the second alternative beverage container.
Figure 10:
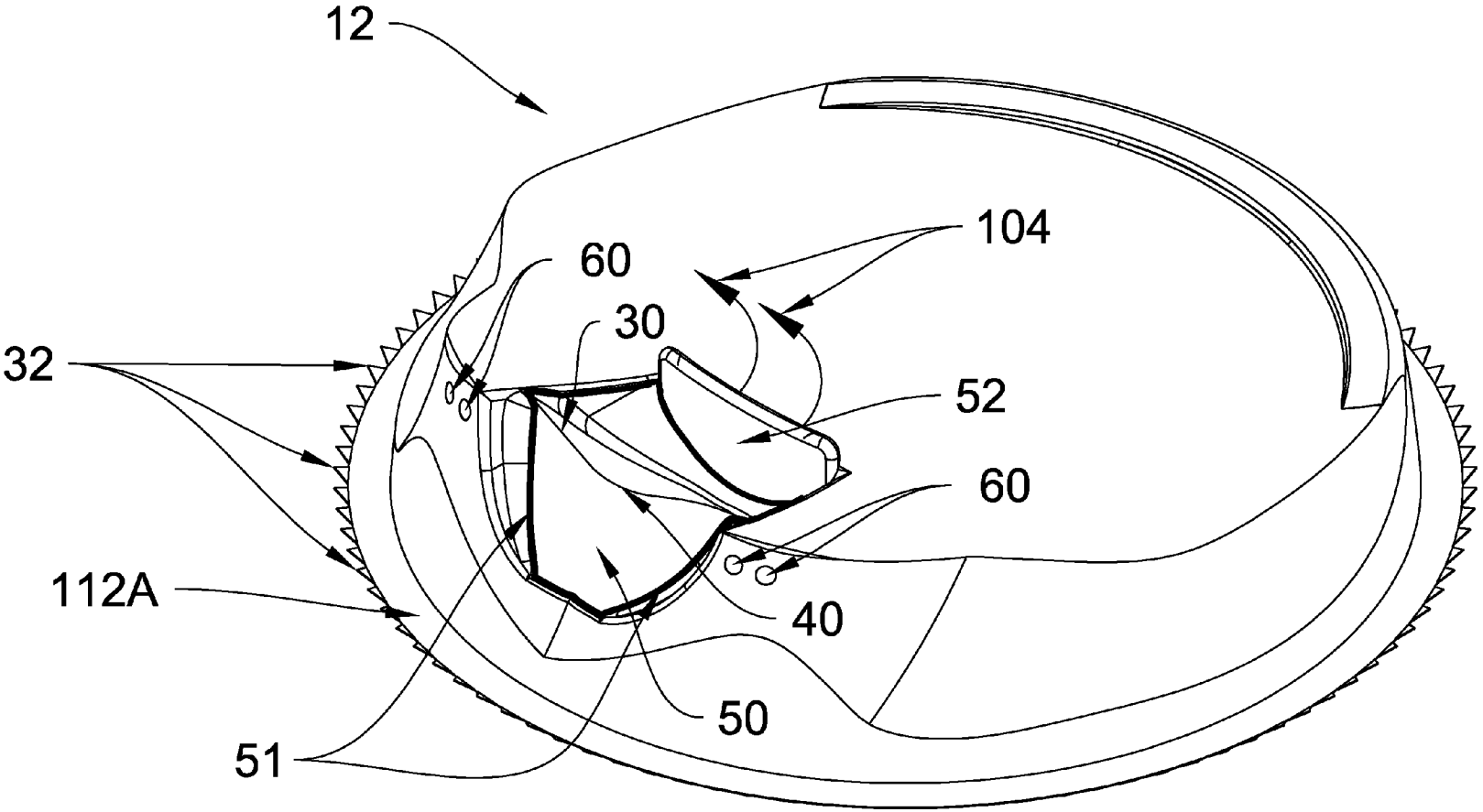
FIG. 10 is an enlarged top perspective type depiction of a first alternative lid insert construction according to the present invention showing the first type of annular, wall-engaging structure with scalloped or continuously serrated, annular, container wall-engaging structure.
Figure 10A:
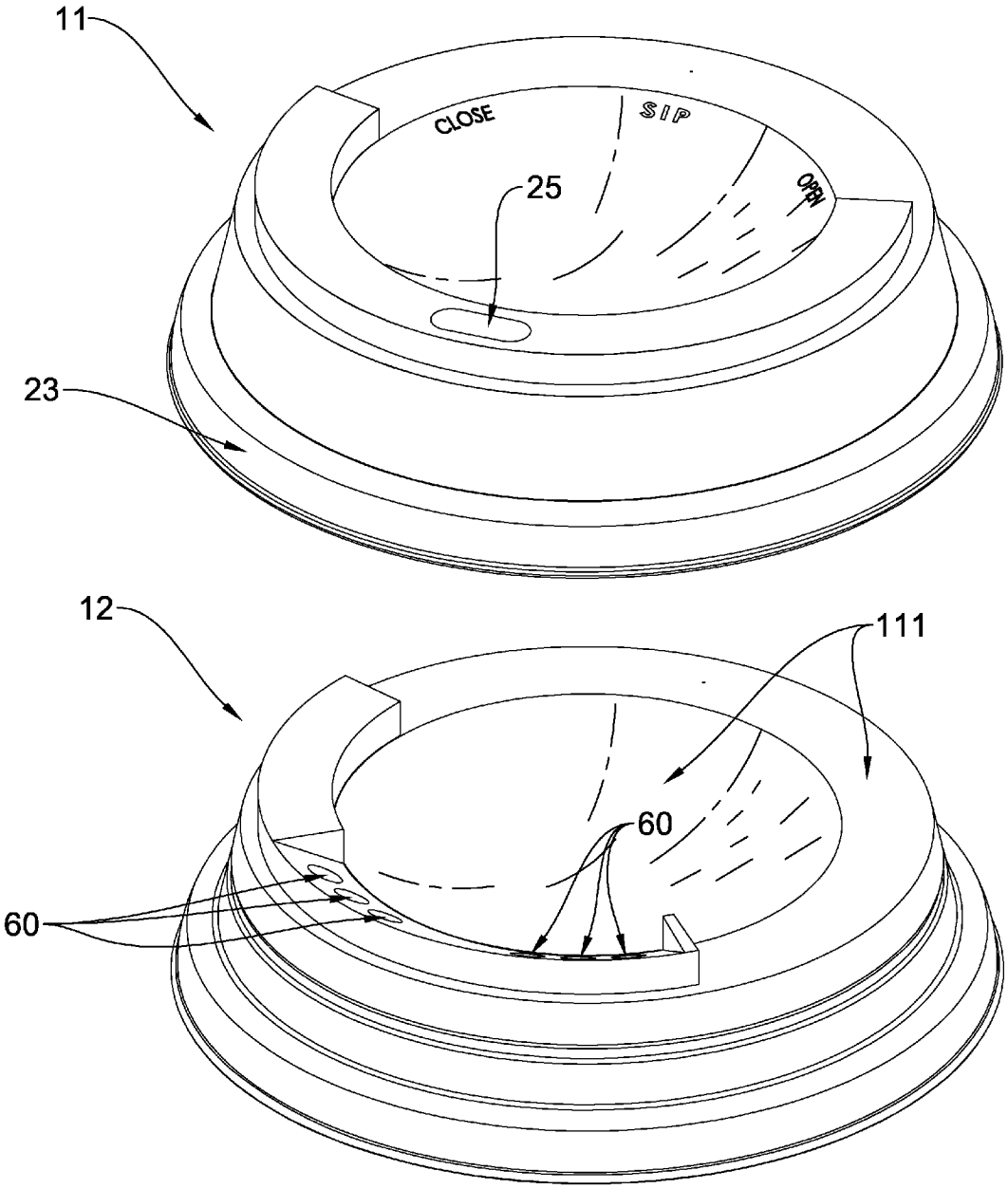
FIG. 10A is an enlarged exploded top perspective view of an upper lid construction and a lower insert construction according to the present invention.
Figure 11A:
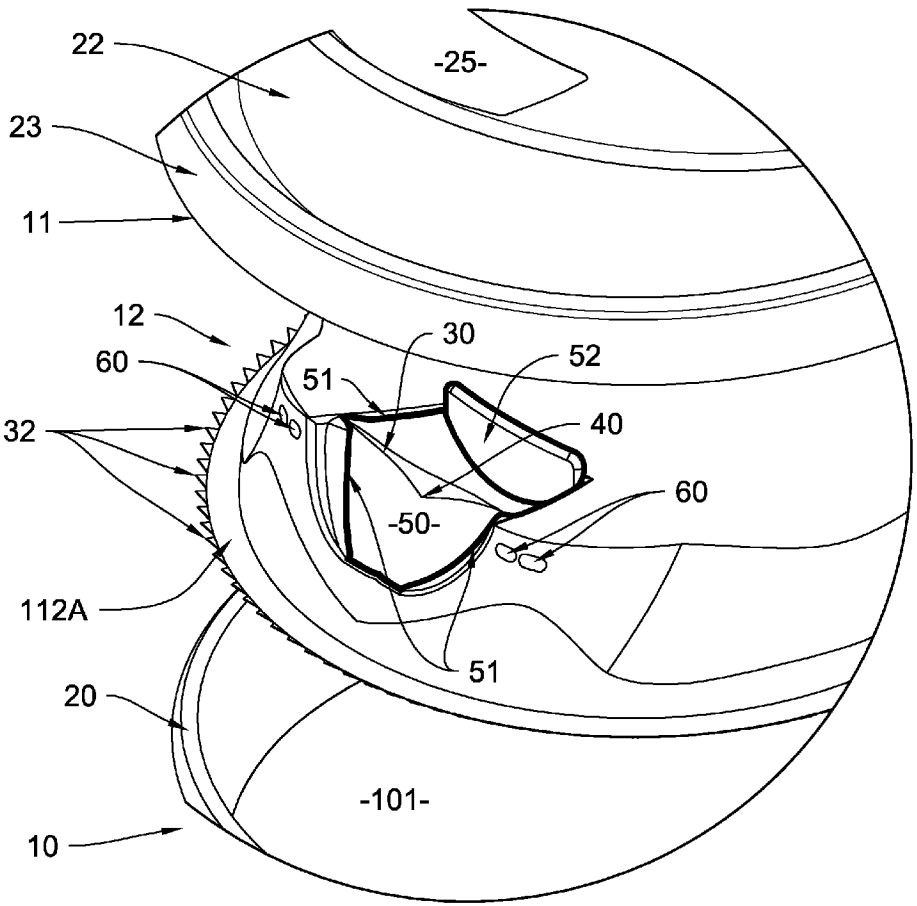
FIG. 11A is an enlarged, fragmentary sectional view of the junction site sectioned from FIG. 11, the view being enlarged to show in greater clarity certain components as otherwise shown and sectioned from FIG. 11 so as to show the first alternative insert construction being outfitted with laterally opposed pairs of damming insert apertures.
Figure 11:
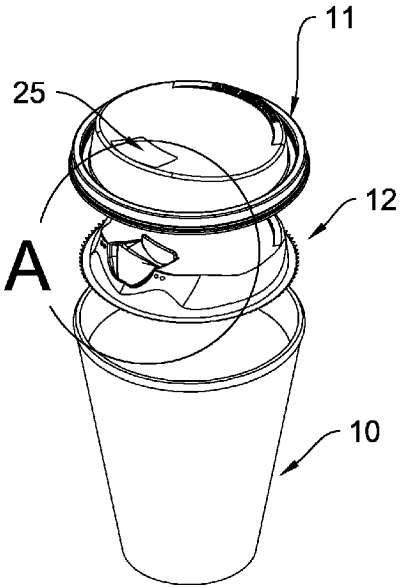
FIG. 11 is a reduced top perspective exploded view of a lid construction, a first alternative insert construction and a beverage container according to the present invention axially aligned relative to one another, the first alternative insert construction being outfitted with laterally opposed pairs of damming insert apertures.

Referencing FIG. 10, it will be seen that the generic insert construction 12 is outfitted with the continuously scalloped or serrated, annular inner container wall-engaging structure 112A, outfitted with radial projections 32, which projections 32 may either be received by structure-receiving or hook-receiving groove(s) or notch(es) 113 formed in the inner wall surfacing 114 of the container wall 19 as generally depicted in FIGS. 1-1B; or pierce the material construction of the container wall 19 at the inner wall surfacing 114 as generally depicted in FIGS. 2C and 2D. It is contemplated that the structures 112 may be cooperable with indentations, grooves, or notches 113 when the container wall 19 consists of or comprises a paper-based material construction, and pierce the material construction of the container wall 19 when the same consists of or comprises a polymeric foam material construction.

The preferred material construction of the beverage container 10 may thus preferably be of a relatively soft, pierceable material such as polystyrene foam or similar type material or paper-based type material construction in which materials the structure-receiving notch(s) 113 may be formed. The inner container wall-engaging lid-to-wall locking structures 112 may be preferably obliquely and upwardly angled relative to a plane transversely intersecting the container wall 19 at the inner container wall surfacing 114. The insert constructions 12 integrally formed with other separately attachable to the locking structures 112 are contemplated to be preferably formed from a thermally-insulative, food-grade, and heat-resistant material. In this last regard, it is contemplated that the material should undergo minimal or minimized structural/dimensional changes when heat 100 is transferred into the material.

Figure 2E:
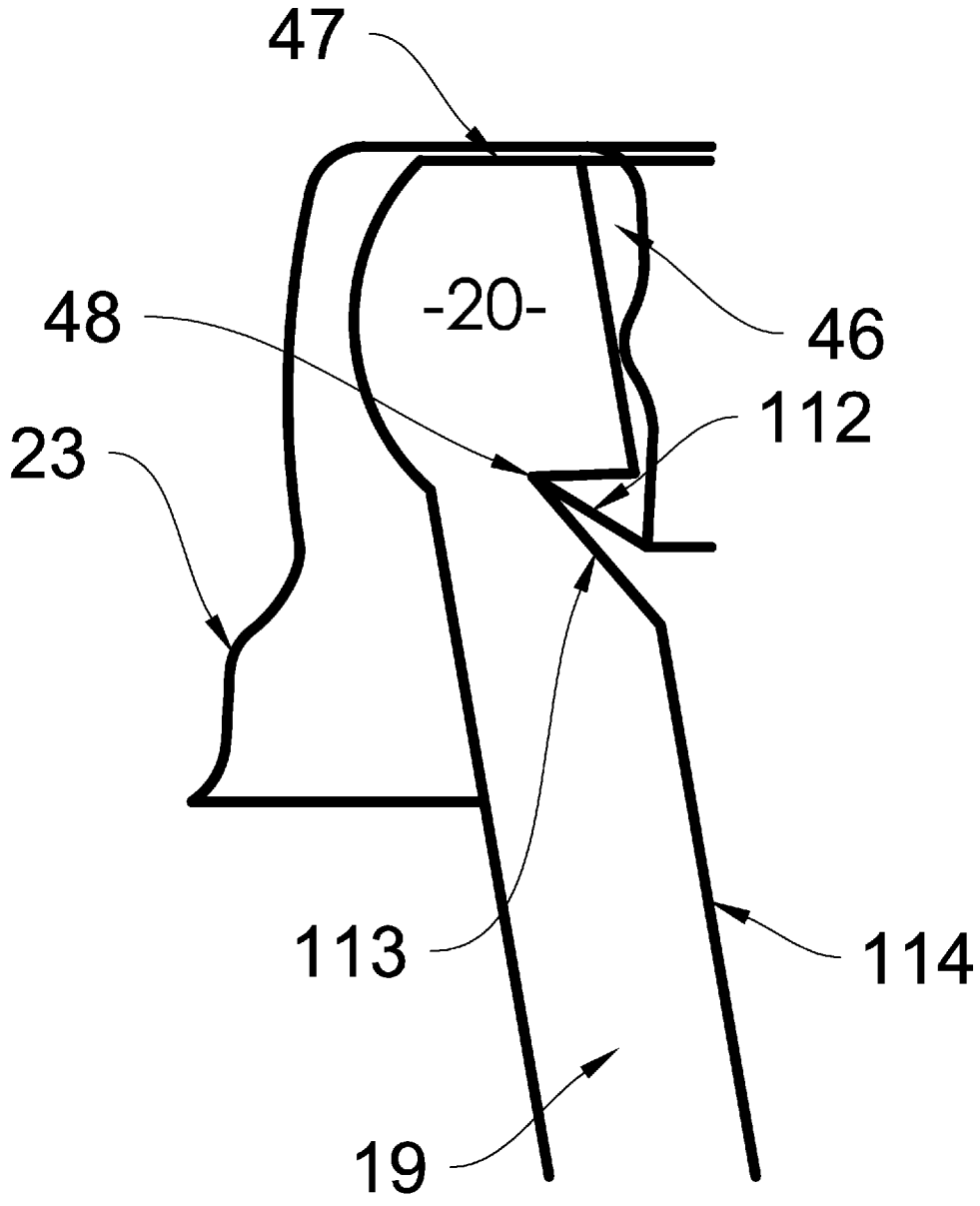
FIG. 2E is a fragmentary, enlarged sectional view of the junction site at the generic lid-insert combination or construction according to the present invention and the first alternative beverage container showing the preferred lid-insert combination or construction according to the present invention attached to the first alternative beverage container.
Figure 2F:
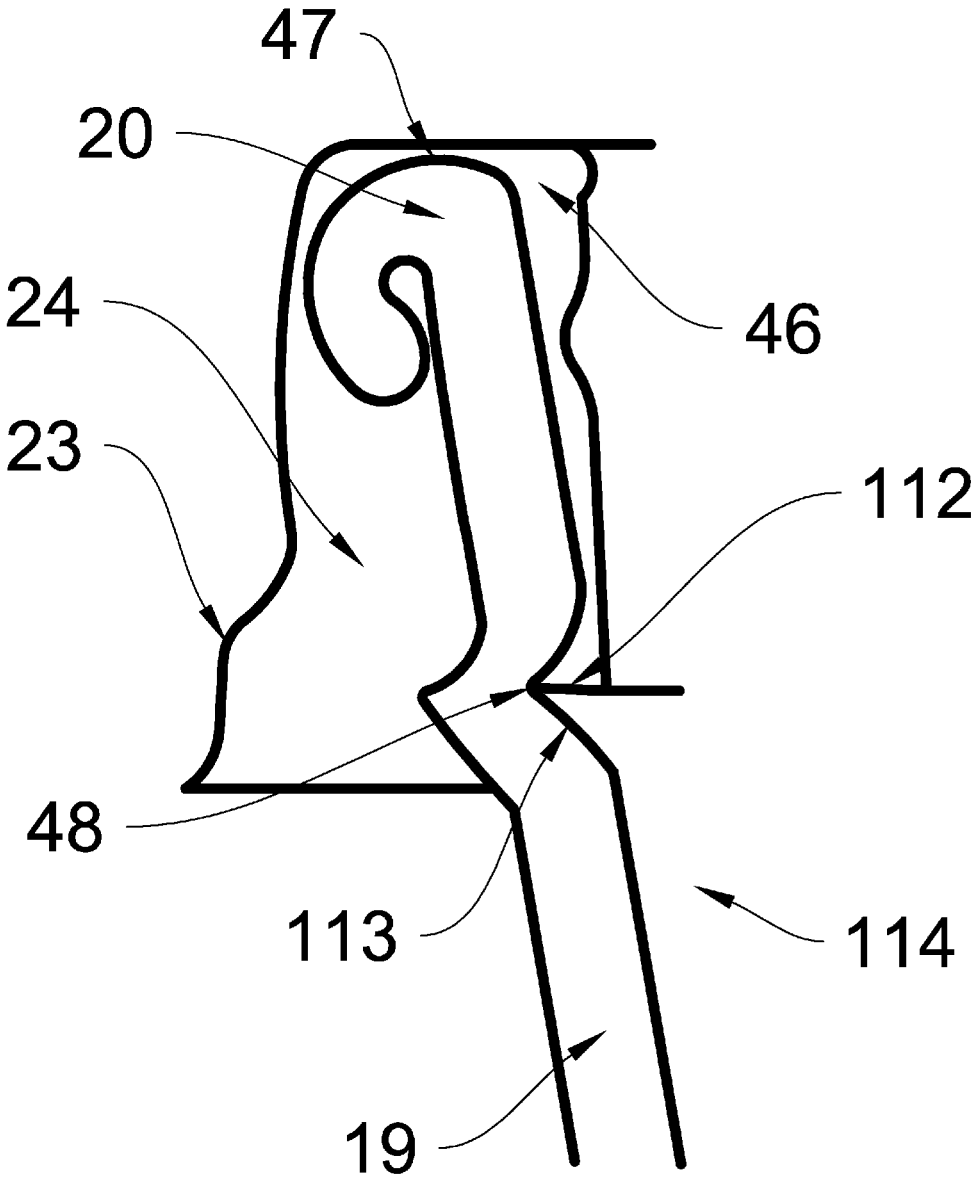
FIG. 2F is a fragmentary, enlarged sectional view of a junction site at a second alternative lid-insert combination or construction according to the present invention and a third alternative beverage container showing the second alternative lid-insert combination or construction according to the present invention attached to the third alternative beverage container.

The wall-engaging structures 112A-112D, as exemplified in FIGS. 5-9, provide enhanced rigidity and/or stability to the upper portions of the outfitted beverage container. Once the lid-insert construction is attached to the beverage container such that the wall-engaging structures 112 (e.g. 112A-112D) engage the container wall 19 via its inner container surfacing 114, an air pocket or air space 46 is formed as perhaps most clearly depicted in FIGS. 2D-2F. The air pocket or space 46, in addition to liquid-tight seals as at upper lid-to-rim seal 47 and lower lid-to-wall seal 48, functions to prevent spillage of beverage 101 from the primary beverage-containing compartment 115.

The insert constructions 12 according to the present invention are preferably outfitted upon the lid construction 11 so as to form beverage-receiving flow channels as at 45 intermediate the insert construction(s) 12 and the lid construction 11 for directing hot beverage 101 through the channels 45 for causing, bringing about, or giving rise to heat transfer 100 from the hot beverage 101 through the material of the insert construction(s) 12 and lid construction 11. The beverage-receiving flow channels 45 and heat transfer 100 caused, brought about, or given rise to by the beverage-receiving flow channels 45 are believed to enhance and/or expedite heat transfer 100 from the hot beverage 101 prior to exiting the primary beverage outlet 25.

The lid-insert combination thus defines certain beverage-receiving flow channels as at 45, which channels 45 are located intermediate an upper-outer material layer as may be exemplified by the lid construction 11 and a lower-inner material layer as may be exemplified by the insert construction 12. Together the lid and insert constructions 11 and 12 may be regarded as a lid-insert combination or simply a lid construction or assembly. The beverage-receiving flow channels 45 are designed to cause or bring about or give rise to an enhanced heat transfer from the hot beverage 101 prior to exiting the primary beverage outlet 25.

The lower-inner material layer as at 111 preferably mimics the contour of the upper-outer material layer of the upper outer lid construction in cross-section as generally and comparatively depicted in FIGS. 19A, 20A, 21A, 22A, and 23A. The mimicking lower-inner material layer 111 essentially minimizes the volumetric space of the beverage-receiving flow channels 45, yet provides certain means for causing, bringing about, or giving rise to enhanced heat transfer from the beverage 101 prior to its outlet from the primary beverage outlet 25.

Referencing FIGS. 25-25C, the reader will consider a number of sequential views depicting the function of the beverage-flow channels 45 according to the present invention. FIG. 25 is a first sequential diagrammatic longitudinal cross-sectional type depiction of a beverage container 10 outfitted with an alternative lid-insert construction according to the present invention shown in a vertical orientation before beverage 101 is redirected toward the primary beverage outlet 25. FIG. 25A is a second sequential diagrammatic longitudinal cross-sectional type depiction of a beverage container 10 outfitted with the alternative lid-insert construction according to the present invention shown in a first angle of inclination off of a vertical orientation for inletting (as at arrow 201) beverage 101 via damming insert apertures 60 into the beverage-cooling channel 45.

FIG. 25B is a third sequential diagrammatic longitudinal cross-sectional type depiction of a beverage container 10 outfitted with the alternative lid-insert construction according to the present invention shown in a vertical orientation with beverage 101 received and pooled within the beverage-cooling channel 45. FIG. 25C is a fourth sequential diagrammatic longitudinal cross-sectional type depiction of a beverage container 10 outfitted with the alternative lid-insert construction according to the present invention shown in an angle of inclination off of a vertical orientation for outletting (as at arrow 201) cooled beverage 101 via the primary beverage outlet 25.

The insert construction 12 or the lower-inner material layer 111 preferably comprises a beverage-damming ridge as at 30, which when outfitted upon the lid construction 11 is situated in inferior adjacency to the primary beverage outlet 25 of the upper-outer material layer or lid construction 11. The beverage-damming ridge 30 essentially functions to prevent beverage spillage and enables the user to control beverage flow rates of the beverage 101 as received within the beverage-receiving flow channels 45 prior to exiting the primary beverage outlet 25. The beverage-damming ridge 30 preferably comprises a centralized dip or trough as at 40, which centralized dip or trough 40 essentially functions to create turbulent air currents in adjacency to the beverage 101 as it passes over the beverage-damming ridge 30, and thus may be said to further refine or enhance heat transfer from the beverage 101 as well as enhance aroma of the beverage 101.

The lower-inner material layer 111 or insert construction 12 preferably further comprises a removable bypass element as at 50, which removable bypass element 50 is formed so as to be situated in inferior adjacency to the primary beverage outlet 25 for enabling the user to selectively bypass the lower-inner material layer 111 by removing the bypass element 50 thereby eliminating beverage-damming formations and essentially opening a secondary beverage outlet aligned with the primary beverage outlet 25 just below the outlet 25 for enabling beverage 101 to flow directly from the beverage-containing compartment 115 of the beverage container 10 through the secondary and primary beverage outlets without obstruction via the damming insert construction 12.

The basic purpose or introduction of the bypass element 50 is in response to user preference indicators that indicate a user may not wish to have beverage 101 diverted through flow channels 45 or cool before it exits the primary beverage outlet 25. Users may, for example, wish to direct the beverage 101 directly from the compartment 115 through the primary beverage outlet 25. To achieve this purpose, the bypass element 50 may be attached to the material layer 111 at a scored seam as at 51, and preferably comprise a pull tab as at 52. The pull tab 52 may thus be pulled as at arrows 104 and the material layer 111 will separate at the scored seam 51 for opening a secondary beverage outlet. The insert constructions 12 may further preferably comprise apertures 60 for selectively inletting beverage and/or air between the flow channels 45 and the beverage-containing compartment 115.

The hot beverage container lid assembly according to the present invention may thus be said to provide certain lid-to-container gripping means as exemplified by the wall-engaging lid-to-wall locking structures illustrated and described by the foregoing specifications. Comparatively referencing FIG. 5 versus FIG. 6 and FIG. 9 versus FIG. 9A, it is contemplated that the wall-engaging lid-to-wall locking structures may be preferably located on only one side of the lid (and insert) construction (or semicircular) so as to enable the user to more easily and selectively remove the lid construction from an outfitted beverage container.

Figure 9A:
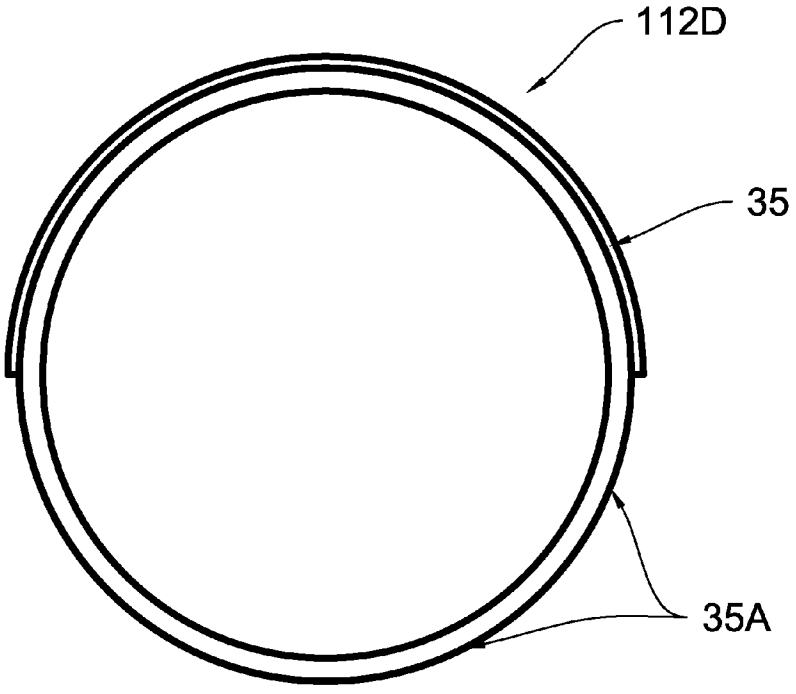
FIG. 9A is a diagrammatic plan type depiction of a fourth (alternative) type of annular, wall-engaging structure according to the present invention showing a semicircular solid, circumferential, radially-extending flange type extension of uniform radial dimension.
Figure 9:
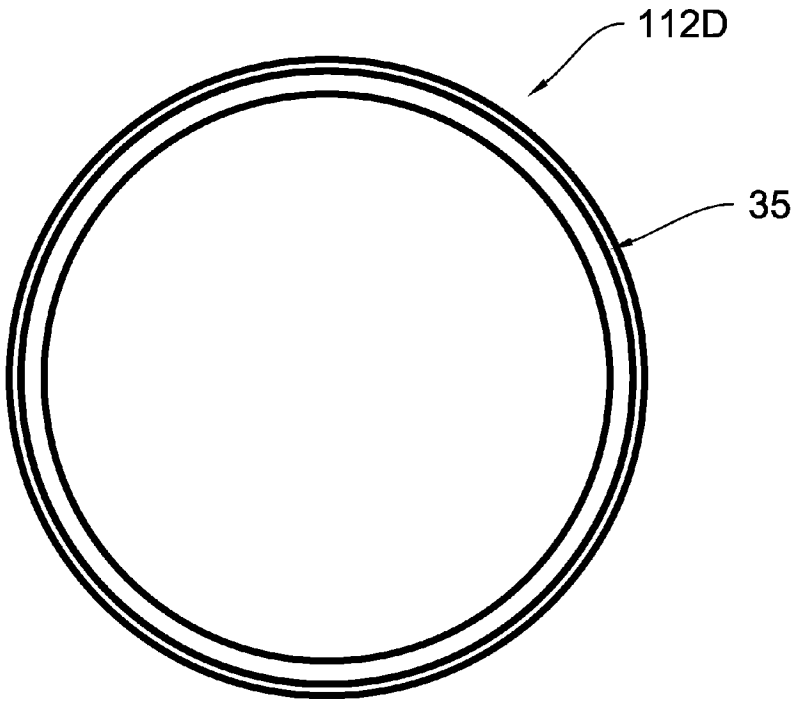
FIG. 9 is a diagrammatic plan type depiction of a fourth type of annular, wall-engaging structure according to the present invention showing a solid, circumferential, radially-extending flange type extension of uniform radial dimension.

In FIG. 6, the reader will there see a semicircular area 32A devoid of serrations, and in FIG. 9A the reader will there see a semicircular area 35A of reduced radial dimension relative radially-extending flange type extension or projection 35. The present invention thus contemplates hemi-circular projections cooperative with the lid construction for hemi-circularly engaging the inner container wall surfacing 114 and selectively enabling release of the locking structure(s) 112. Further, the overall lid construction, when outfitted with the wall-engaging lid-to-wall locking structure, comprises increased rigidity of the lid construction, which increased rigidity of the lid construction adds rigidity to the outfitted beverage container for enhancing safety thereof.

While the foregoing specifications set forth much specificity, the same should not be construed as setting forth limits to the invention but rather as setting forth certain preferred embodiments and features. For example, as prefaced hereinabove, it is contemplated that the present invention essentially provides a container lid-insert combination or construction, the container lid-insert combination or construction primarily for preventing inadvertent removal of the lid construction (incorporating container-gripping means as exemplified by the lid-to-wall locking structures appearing at 112A-112D) from a beverage container, and secondarily for enabling a user to transfer heat from a relatively hot assembly-contained beverage.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures, and the appended claims and drawings.

I claim:

1. A hot beverage container assembly, the hot beverage container assembly comprising, in combination:

a beverage container and a lid construction, the beverage container comprising an inner container wall surfacing and an upper container rim, the lid construction comprising a primary beverage outlet and a container-to-lid interface assembly, the container-to-lid interface assembly comprising means for receiving the upper container rim and an inner container wall-engaging, lid-to-wall locking structure, the lid construction being outfitted upon the beverage container such that the upper container rim is received by the means for receiving the upper container rim and the inner container wall-engaging, lid-to-wall locking structure engages and effectively locks the lid construction to the inner container wall surfacing, the lid construction, being outfitted upon the beverage container, defining a lower beverage-receiving compartment and at least one upper beverage flow channel, each beverage flow channel for receiving heat from a beverage before said beverage exits the primary beverage outlet.

2. The hot beverage container assembly of claim 1 wherein the inner container wall surfacing comprises a structure-receiving notch, the inner container wall-engaging, lid-to-wall locking structure being receivable in the structure-receiving notch.

3. The hot beverage container assembly of claim 1 wherein the inner container wall surfacing is pierceable, the pierceable inner container wall surfacing being pierced by the inner container wall-engaging, lid-to-wall locking structure when the lid construction is outfitted upon the beverage container.

4. The hot beverage container assembly of claim 1 wherein the lid construction defines beverage-receiving flow channels intermediate an upper-outer material layer and a lower-inner material layer of said lid construction, the beverage-receiving flow channels for causing heat transfer from the hot beverage prior to exiting the primary beverage outlet.

5. The hot beverage container assembly of claim 4 wherein the lower-inner material layer mimics the upper-outer material layer in cross-section, the mimicking lower-inner material layer for minimizing the volumetric space of the beverage-receiving flow channels.

6. The hot beverage container assembly of claim 5 wherein the lower-inner material layer comprises a beverage-damming ridge in inferior adjacency to the primary beverage outlet of the upper-outer material layer, the beverage-damming ridge for preventing beverage spillage and enabling the user to control beverage flow rates of the beverage received within the beverage-receiving flow channels prior to exiting the primary beverage outlet.

7. The hot beverage container assembly of claim 6 wherein the beverage-damming ridge comprises a centralized trough, the centralized trough for creating turbulent air currents in adjacency to the beverage as the beverage passes over the beverage-damming ridge, the centralized trough thus for further enhancing heat transfer from the beverage.

8. The hot beverage container assembly of claim 4 wherein the lower-inner material layer comprises a removable bypass element, the removable bypass element being formed in inferior adjacency to the primary beverage outlet for enabling the user to selectively bypass the lower-inner material layer by removing the bypass element thereby opening a secondary beverage outlet in inferior adjacency to the primary beverage outlet for enabling beverage to flow directly from the beverage-containing compartment of the beverage container through the secondary and primary beverage outlets.

9. The hot beverage container assembly of claim 8 wherein the bypass element comprises a pull tab, the pull tab for enabling the user to more easily and manually remove the bypass element.

10. A lid construction attachable to a select beverage container for preventing inadvertent removal of the lid construction from the select beverage container, the lid construction comprising:

an inner container wall-engaging, lid-to-wall locking structure, the lid construction being outfittable upon the select beverage container such that the inner container wall-engaging, lid-to-wall locking structure engages an inner container wall surfacing of the select beverage container for preventing inadvertent removal of the lid construction from the select beverage container, the inner container wall surfacing comprising a structure-receiving notch and being piercable, the inner container wall-engaging, lid-to-wall locking structure being receivable in the structure-receiving notch and piercing the inner container wall surfacing when the lid construction is outfitted upon the select beverage container.

11. The lid construction of claim 10 wherein the lid construction defines at least one beverage-receiving flow channel intermediate an upper-outer material layer and a lower-inner material layer of said lid construction, the at least one beverage-receiving flow channel for causing heat transfer from a hot beverage prior to exiting a primary beverage outlet formed in the lid construction.

12. The lid construction of claim 11 wherein the lower-inner material layer mimics the upper-outer material layer in cross-section, the mimicking lower-inner material layer for minimizing the volumetric space of each beverage-receiving flow channel.

13. The lid construction of claim 11 wherein the lower-inner material layer comprises a beverage-damming ridge in inferior adjacency to the primary beverage outlet of the upper-outer material layer, the beverage-damming ridge for preventing beverage spillage and enabling the user to control beverage flow rates of the beverage received within each beverage-receiving flow channel prior to exiting the primary beverage outlet.

14. The lid construction of claim 13 wherein the beverage-damming ridge comprises a centralized trough, the centralized trough for creating turbulent air currents in adjacency to the beverage as the beverage passes over the beverage-damming ridge, the centralized trough thus for enhancing heat transfer from the beverage.

15. The lid construction of claim 13 wherein the lower-inner material layer comprises a removable bypass element, the removable bypass element being formed in inferior adjacency to the primary beverage outlet for enabling the user to selectively bypass the lower-inner material layer by removing the bypass element and opening a secondary beverage outlet in alignment with the primary beverage outlet for enabling beverage to flow directly from a beverage-containing compartment of the beverage container through the secondary and primary beverage outlets.

16. The lid construction of claim 15 wherein the bypass element comprises a pull tab, the pull tab for enabling the user to more easily and manually remove the bypass element.

17. A lid insert construction attachable to a beverage container lid for preventing inadvertent removal of the beverage container lid from a beverage container, the lid insert construction comprising:

an inner container wall-engaging, lid-to-wall locking structure, the lid construction being outfittable upon a beverage container such that the inner container wall-engaging, lid-to-wall locking structure engages an inner container wall surfacing of the beverage container for preventing inadvertent removal of the beverage container lid from the beverage container.

18. The lid insert construction of claim 17 wherein the lid insert construction defines at least one beverage-receiving flow channel intermediate the beverage container lid and a lower-inner material layer of said lid insert construction, the at least one beverage-receiving flow channel for causing heat transfer from a hot beverage prior to exiting a primary beverage outlet formed in the beverage container lid.

19. The lid insert construction of claim 18 wherein the lid insert construction provides beverage-oscillation damping means, the beverage-oscillation damping means for damping beverage oscillations within the beverage container.

20. The lid insert construction of claim 18 wherein the lid insert construction provides beverage-redirection means for redirecting beverage away from the primary beverage outlet to prevent beverage spillage.

21. The lid insert construction of claim 17 wherein the inner container wall-engaging, lid-to-wall locking structure is semicircular for enabling the user to more easily and selectively remove the beverage container lid from the beverage container.

22. A lid construction attachable to a select beverage container for preventing inadvertent removal of the lid construction from the select beverage container, the lid construction comprising:

an inner container wall-engaging, lid-to-wall locking structure, the lid construction being outfittable upon the select beverage container such that the inner container wall-engaging, lid-to-wall locking structure pierces a piercable inner container wall surfacing of the select beverage container for preventing inadvertent removal of the lid construction from the select beverage container.

23. The lid construction of claim 22 wherein the lid construction defines at least one beverage-receiving flow channel intermediate an upper-outer material layer and a lower-inner material layer of said lid construction, the at least one beverage-receiving flow channel for causing heat transfer from a hot beverage prior to exiting a primary beverage outlet formed in the lid construction.

* * * * *